US006547574B2

(12) United States Patent
Sasaki et al.

(10) Patent No.: US 6,547,574 B2
(45) Date of Patent: Apr. 15, 2003

(54) CONNECTOR CONNECTING DEVICE

(75) Inventors: Harehide Sasaki, Aichi (JP); Yoshiaki Kato, Aichi (JP); Toshiki Nunotani, Aichi (JP); Kazuyuki Shiraki, Aichi (JP)

(73) Assignees: Kabushiki Kaisha Tokai Rika Denki Seisakusho, Aichi (JP); Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 09/737,816

(22) Filed: Dec. 18, 2000

(65) Prior Publication Data

US 2001/0046797 A1 Nov. 29, 2001

(30) Foreign Application Priority Data

Dec. 17, 1999 (JP) ..... 11-358873

(51) Int. Cl.[7] ..... H01R 13/62
(52) U.S. Cl. ..... 439/157; 439/160
(58) Field of Search ..... 439/310, 347, 439/372, 376, 152–160, 345, 352, 330

(56) References Cited

U.S. PATENT DOCUMENTS 5,876,226 A * 3/1999 Tsukakoshi et al. ..... 439/157
5,924,880 A 7/1999 Watanabe et al.
5,954,528 A 9/1999 Ono et al.
6,102,717 A * 8/2000 Aoki et al. ..... 439/157
6,193,530 B1 * 2/2001 Sakurai et al. ..... 439/157

FOREIGN PATENT DOCUMENTS

JP 11-26067 1/1999

OTHER PUBLICATIONS

Patent Abstracts of Japan, Publication No. 11 026079, Publication date Jan. 29, 1999, vol. 1999, No. 04.
Patent Abstracts of Japan, Publication No. 11 260474, Publication date Sep. 24, 1999, vol. 1999, No. 14.
Patent Abstracts of Japan, Publication No. 11 250984, Publication date Sep. 17, 1999, vol. 1999, No. 14.
Patent Abstracts of Japan, Publication No. 06 295767, Publication date Oct. 21, 1994, vol. 1999, No. 07.

* cited by examiner

*Primary Examiner*—Renee Luebke
*Assistant Examiner*—Phuongchi Nguyen
(74) *Attorney, Agent, or Firm*—Morgan, Lewis & Bockius LLP

(57) ABSTRACT

A lever (14) is pivotally movably supported on a female connector (11). In accordance with the movement of a slide member (13) relative to the female connector (11), the lever (14) is pivotally moved while held in engagement with a tongue portion **(29*b*) of an engagement portion (29) formed on a male connector (16), and with this construction the inserting force is reduced. When the slide member (13) is completely drawn out relative to the female connector (11), an engagement projection (14*g*) of the lever (14) is engaged with an engagement claw (26*a*) of an elastic arm portion (26), and the lever (14) is held in this position. When a projection (29*a*) of the engagement portion (29) elastically deforms the elastic arm portion (26), the retained condition of the lever (14) is canceled, so that the lever (14)** is allowed to be pivotally moved.

16 Claims, 25 Drawing Sheets

A-A CROSS-SECTIONAL VIEW

B-B CROSS-SECTIONAL VIEW

C-C CROSS-SECTIONAL VIEW

D-D CROSS-SECTIONAL VIEW

E-E CROSS-SECTIONAL VIEW

F-F CROSS-SECTIONAL VIEW

G-G CROSS-SECTIONAL VIEW

H-H CROSS-SECTIONAL VIEW

I-I CROSS-SECTIONAL VIEW

J-J CROSS-SECTIONAL VIEW

K-K CROSS-SECTIONAL VIEW

L-L CROSS-SECTIONAL VIEW

M-M CROSS-SECTIONAL VIEW

N-N CROSS-SECTIONAL VIEW

CONNECTOR CONNECTING DEVICE

BACKGROUND OF THE INVENTION

1. Technical Field

This invention relates to a connector connecting device in which an inserting-drawing force, acting between two connectors, is reduced, utilizing the pivotal movement of a lever.

2. Related Art

A large inserting-drawing force is required for interconnecting two connectors having multi-pole terminals. Therefore, there has been proposed an interconnecting device of the type in which the large inserting-drawing force is obtained with a small force, utilizing the leverage of a lever.

FIG. 43 shows an interconnecting device of this type disclosed in JP-A-11-26067. In this construction, a slide member 1 is slidably mounted on one connector 2. A lever 3, supported on the slide member 1, is pivotally moved in accordance with the sliding movement of the slide member 1 relative to the one connector 2. In this case, when the slide member 1 is slid, a distal end of the lever 3 engages an engagement portion 5 formed on the other connector 4, and in accordance with the pivotal movement of the lever 3, the one connector 1 is drawn into the other connector 4 with a large force, thereby connecting the two connectors (see FIGS. 44 to 46).

However, in this construction, the lever is pivotally mounted. Therefore for connecting the two connectors, it is necessary to draw the one connector 1 into the other connector 4, with the slide member 1 kept in a completely drawn-out condition relative to the one connector 2, and the operation for connecting the two connectors is very cumbersome.

SUMMARY OF THE INVENTION

This invention has been made under the above circumstance, and an object of the invention is to provide a connector-interconnecting device in which two connectors are connected together, utilizing the pivotal movement of a lever effected in accordance with the sliding movement of a slide member, and the operation for interconnecting the two connectors can be effected easily.

According to the present invention, there is provided a connector-interconnecting device comprising a lever pivotally mounted on one of a male connector and a female connector; a slide member which is slidably mounted on the one connector, having the lever mounted thereon, and pivotally moves the lever in accordance with a sliding movement of the slide member; and an engagement portion formed on the other connector, the lever being engageable with the engagement portion in accordance with the pivotal movement of the lever; wherein an operating force, applied to the slide member, is converted into the pivotal movement of the lever, thereby reducing an inserting-drawing force acting between the two connectors;

wherein there is provided a holding mechanism for holding the lever against pivotal movement by engagement with the one connector when the slider is kept in a drawn-out condition relative to the one connector.

In this construction, the lever is held against pivotal movement by the holding mechanism through the engagement with the one connector, and therefore the slide member is held in a drawn-out position relative to the one connector.

The slide member, mounted on the one connector, is pushed, with the one connector held against the other connector. At this time, when the holding or retaining of the lever by the holding mechanism is canceled, the lever is allowed to be pivotally moved, and the lever is pivotally moved in accordance with the sliding movement of the slide member from a slide start position, and is brought into engagement with the engagement portion provided at the other connector.

Then, when the slide member is further pushed, the lever, held in engagement with the engagement portion provided at the other connector, is further pivotally moved, and the force, applied to the slide member is amplified, and serves as a force for pushing the one connector into the other connector because of leverage in which case an engagement portion of the lever, held in engagement with the engagement portion, serves as a supporting point, and the axis portion of the lever serves as an application point, and that portion of the lever, connected to the slide member, serves as a force-applying point. Therefore, the large force for connecting the two connectors together can be obtained by the small pushing force applied to the slide member, and the one connector can be easily inserted into the other connector.

Then, when the slide member is pushed into a slide finish position relative to the one connector, the two connectors are completely connected together.

When the one connector is to be drawn from the other connector, the slide member is drawn out relative to the one connector. As a result, the drawing force, applied to the slide member, is amplified, and serves as a draw force for drawing the one connector from the other connector, as described above for the inserting operation. Therefore, the large force for canceling the connection between the two connectors can be obtained with the small drawing force applied to the slide member, and the one connector can be easily drawn from the other connector.

In the above construction, preferably, holding cancellation means is provided at the other connector, and during the time when the one connector is inserted into and drawn from the other connector, the holding cancellation means cancels the holding of the lever by the holding mechanism.

In this construction, when the slide member, mounted on the one connector, is pushed, with the one connector held against the other connector, the holding cancellation means cancels the retaining or holding of the lever by the holding mechanism, so that the lever is automatically brought into a pivotally-movable condition.

In the above construction, preferably, at the time when the lever begins to engage the engagement portion, a line, interconnecting an axis of pivotal movement of the lever and a force-applying point of the lever, at which a force is applied to the lever from the slide member, is disposed generally perpendicularly to a direction of sliding of the slide member.

In this construction, at the time when the lever begins to engage the engagement portion, a line, interconnecting the supporting point of the lever and the force-applying point of the lever, at which the force is applied to the lever from the slide member, is disposed generally perpendicularly to the direction of sliding of the slide member, and therefore the maximum force can be applied to the lever from the slide member, and the force for initiating the connection between the two connectors can be reduced to a very small level.

Preferably, a pair of opposed support portions are formed on the one connector, and are spaced a predetermined distance from each other, and the lever, inserted in a gap between the support portions, is pivotally movably supported by the support portions in such a manner that the lever is held between the support portions, and the lever has slanting surfaces, and when the lever is inserted into the gap between the support portions, the slanting surfaces are brought into sliding contact with peripheral edges of head portions of the support portions, respectively.

With this construction, when the lever is inserted into the gap between the support portions, the slanting surfaces, formed on the lever, are brought into sliding contact with the support portions, respectively, and therefore the lever can be easily inserted into the gap between the support portions.

When the lever is pivotally moved a predetermined angle from a rotation start position in accordance with the sliding movement of the slide member, the lever is brought into engagement with the engagement portion.

In this construction, the lever is pivotally moved to increase its rotation force before the lever is brought into engagement with the engagement portion, and therefore the force of engagement of the lever with the engagement portion is increased.

A terminal holder is mounted on the one connector to prevent terminals from being drawn from the one connector, and when the terminal holder is incompletely mounted on the one connector, the terminal holder projects into a path of sliding movement of the slide member.

With this construction, when the terminal holder is mounted on the one connector, the terminals are prevented from withdrawal. In this case, when the terminal holder is incompletely mounted on the one connector, the terminal holder projects into the path of sliding movement of the slide member, and therefore the sliding movement of the slide member is prevented. Therefore, it can be judged that the mounting of the terminal holder is incomplete. When the slide member is completely slid, the terminal holder is covered with the slide member. Therefore, even if the terminal holder is slightly drawn, the terminal holder contacts the slide member, and is prevented from being further drawn. Thus, the complete withdrawal of the terminal holder is positively prevented..

DETAILED DESCRIPTION OF PREFERRED EMBODIMENT

One preferred embodiment of the present invention will now be described with reference to FIGS. 1 to 42.

Figure 1:
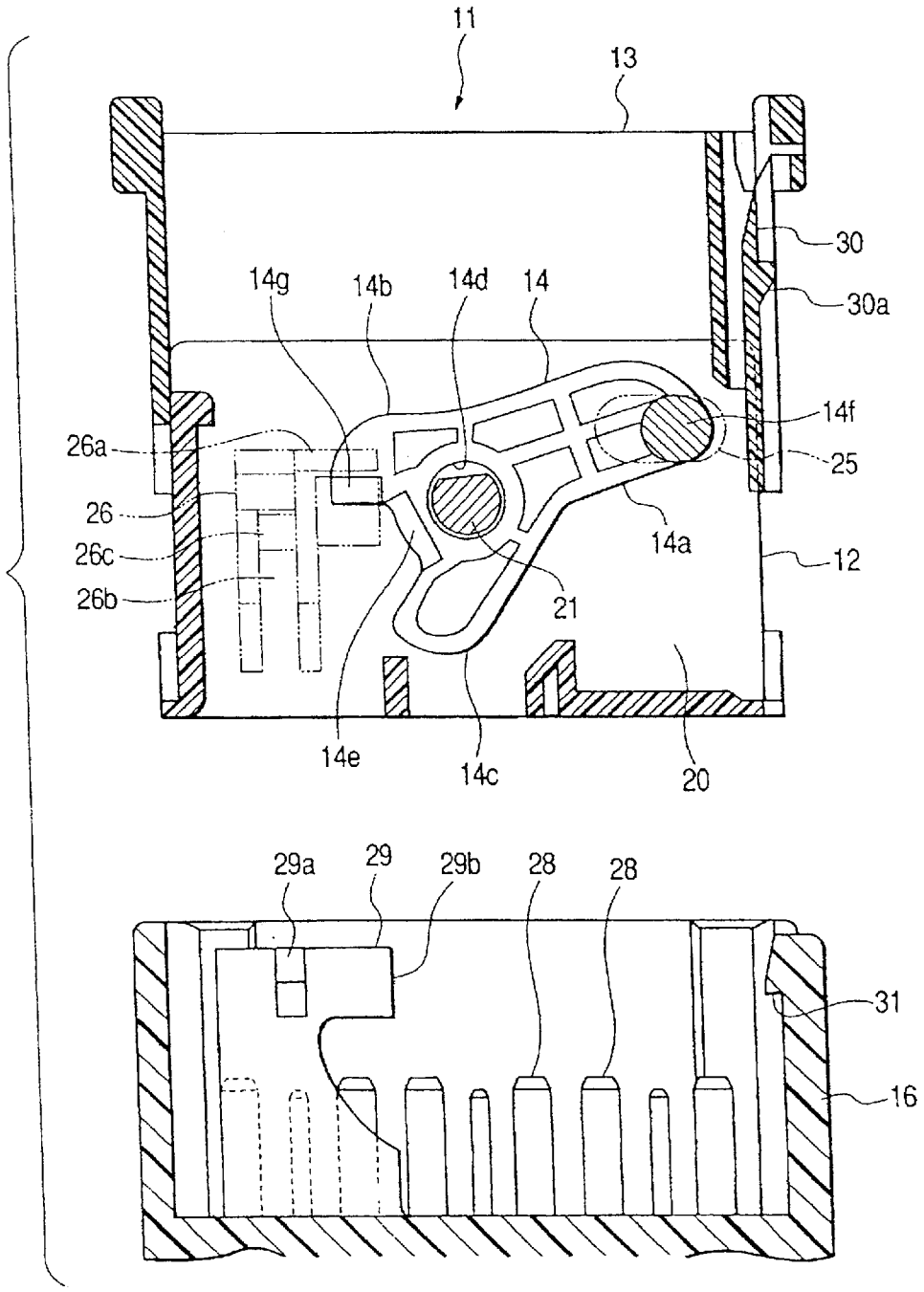
FIG. 1 is a vertical cross-sectional, front-elevational view of one preferred embodiment of the invention, including a female connector and a male connector.
Figure 2:
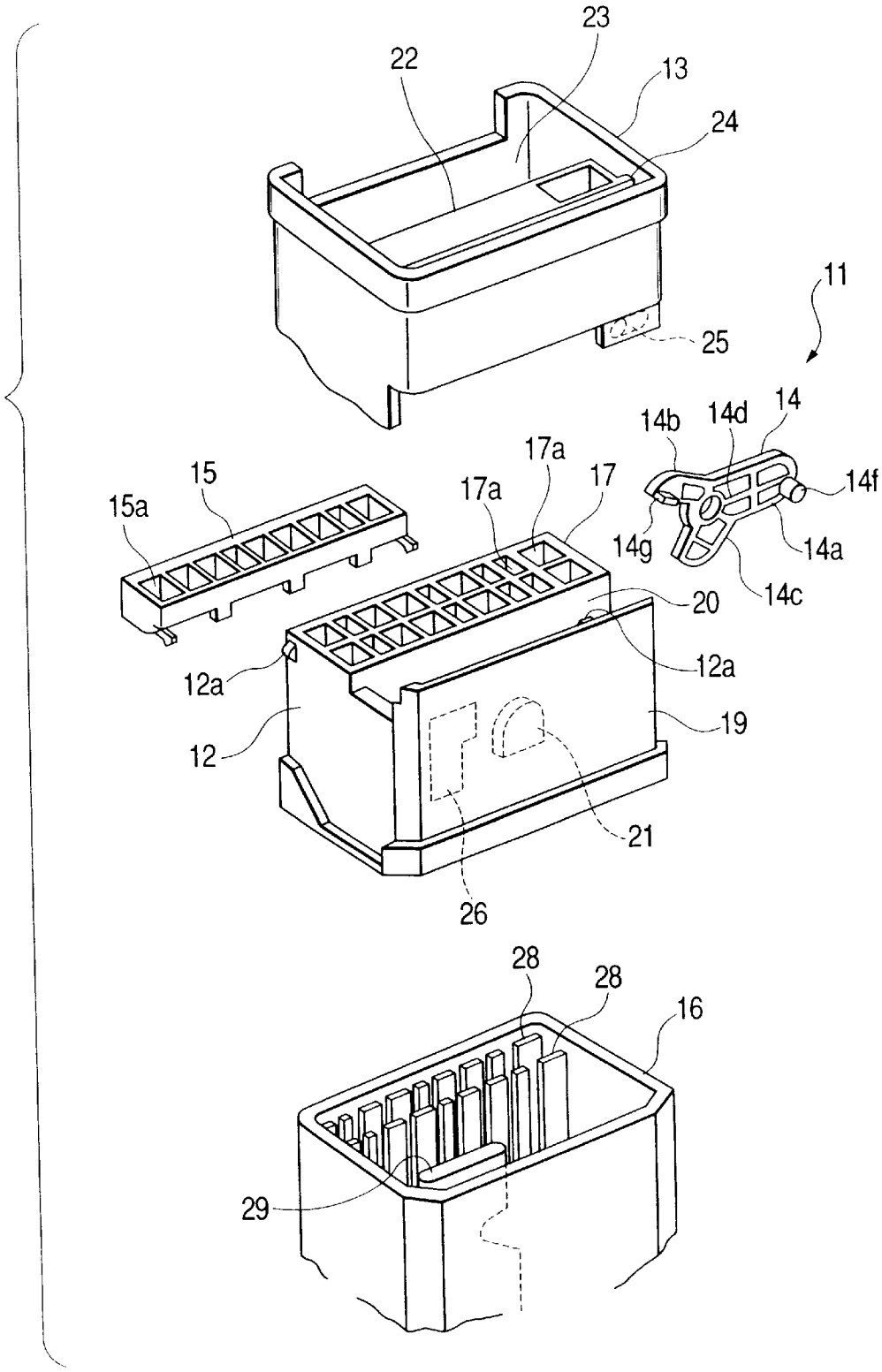
FIG. 2 is an exploded, perspective view of the female connector.

FIG. 1 is a vertical cross-sectional, front-elevational view showing a female connector and a male connector, and FIG. 2 is an exploded, perspective view of the female connector. In FIGS. 1 and 2, the female connector 11 includes a connector body 12, a slide member 13, a lever 14 and a terminal holder 15. The lever 14 and the terminal holder 15 are mounted on the connector body 12, and the slide member 13 is mounted on the outer periphery of the connector body 12.

The male connector 16 is formed integrally with an electric equipment according to a predetermined standard. A cable is connected to the electric equipment by connecting the female connector 11 to the male connector 16.

Figure 3:
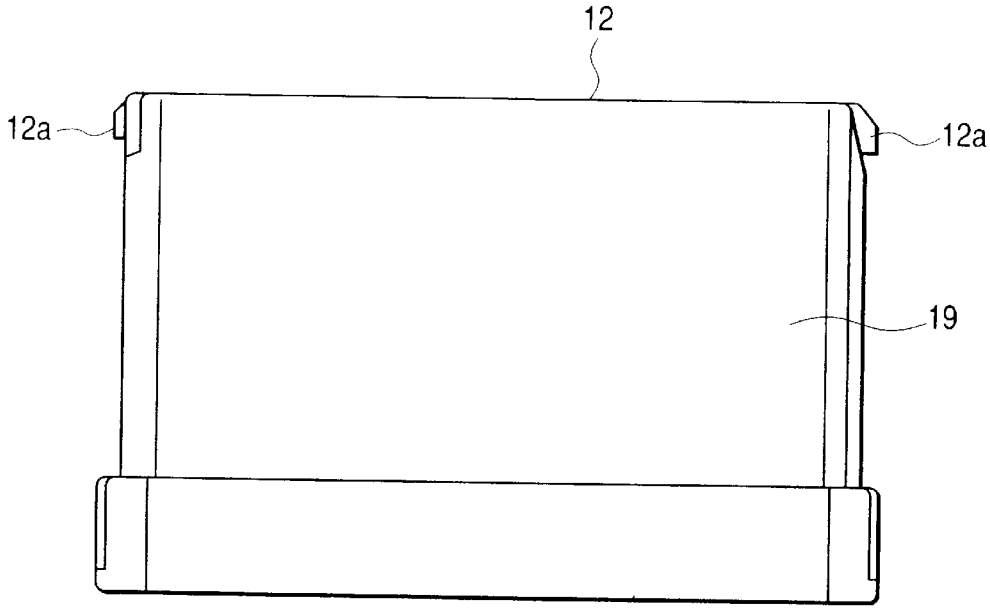
FIG. 3 is a front-elevational view of a connector body.
Figure 4:
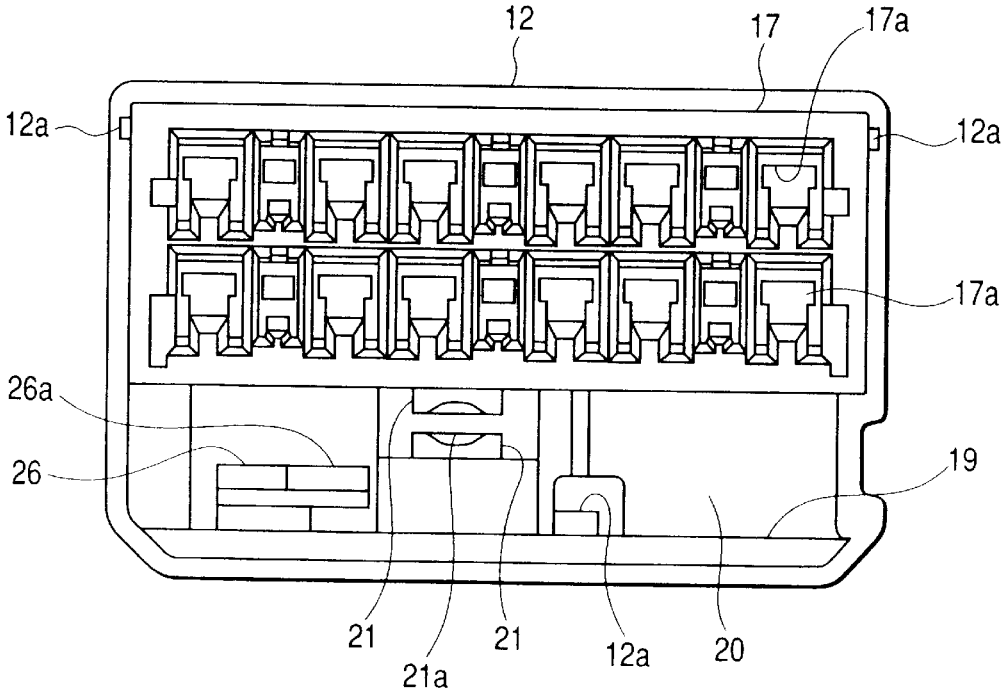
FIG. 4 is a plan view of the connector body.
Figure 5:
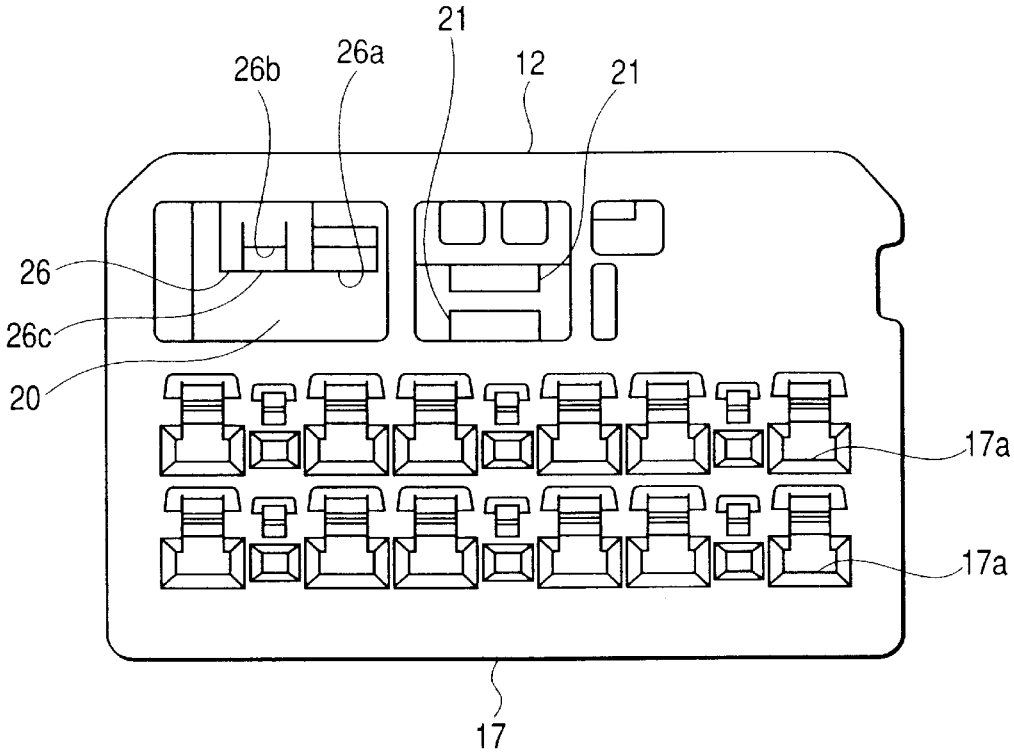
FIG. 5 is a bottom view of the connector body.
Figure 6:
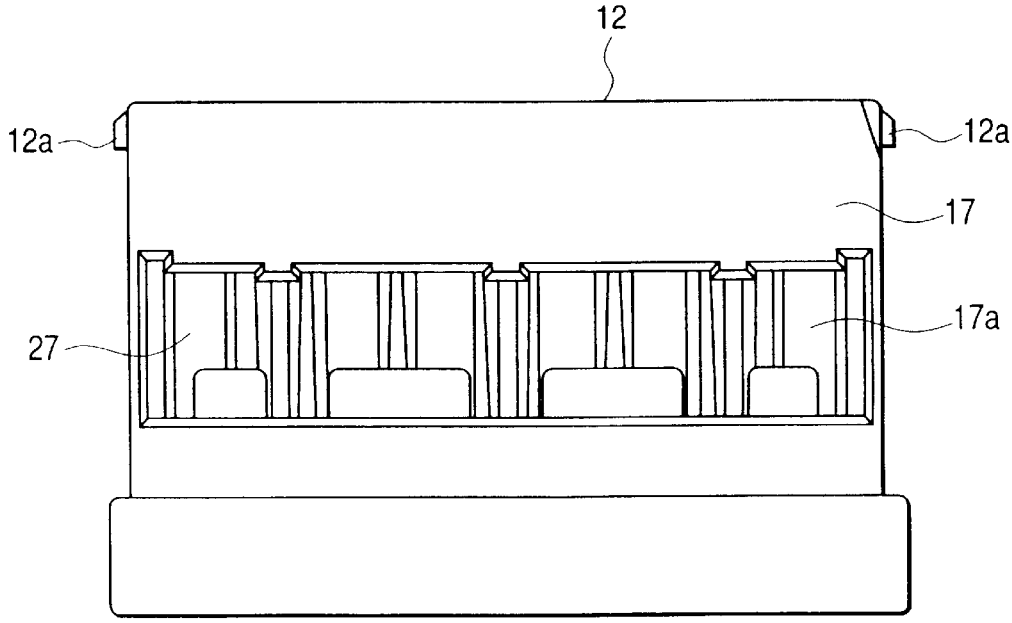
FIG. 6 is a rear view of the connector body.
Figure 7:
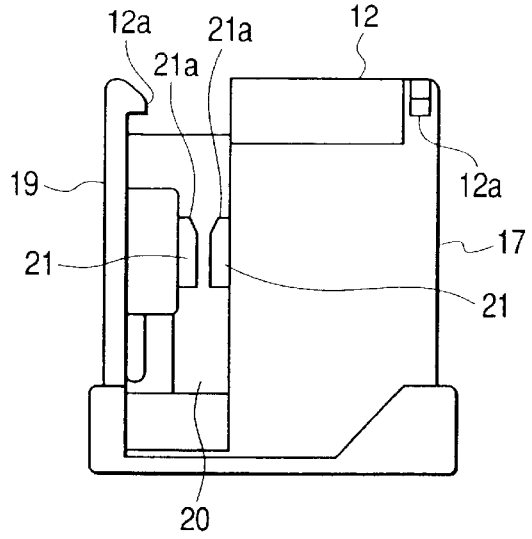
FIG. 7 is a side-elevational view of the connector body.

FIG. 3 is a front-elevational view of the connector body 12, FIG. 4 is a plan view of the connector body 12, FIG. 5 is a bottom view of the connector body 12, FIG. 6 is a rear view of the connector body 12, and FIG. 7 is a side-elevational view of the connector body 12. In FIGS. 3 to 7, a terminal mounting portion 17 is formed at the connector body 12. This terminal mounting portion 17 has two rows of terminal insertion holes 17*a*. Female terminals 18 (see FIGS. 17 and 18) are adapted to be inserted into these terminal insertion holes 17*a*, respectively. A side wall portion 19 is formed at this connector body, and is spaced a predetermined distance from the terminal mounting portion 17, and a lever receiving chamber 20 is formed between the terminal mounting portion 17 and the side wall portion 19.

In the lever receiving chamber 20, a pair of opposed support portions 21 are formed respectively on the terminal mounting portion 17 and the side wall portion 19, and are spaced a predetermined distance from each other. The lever 14 is pivotally supported in the gap between the two support portions 21.

Figure 8:
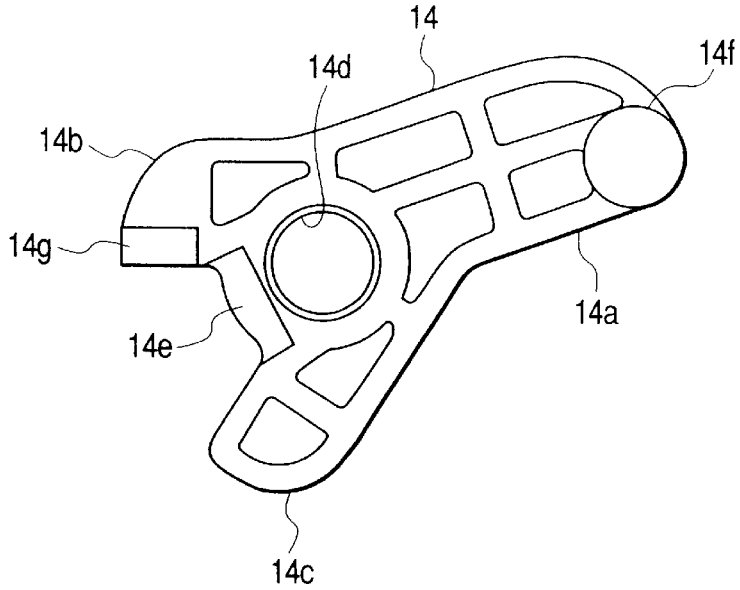
FIG. 8 is a front-elevational view of a lever.
Figure 9:
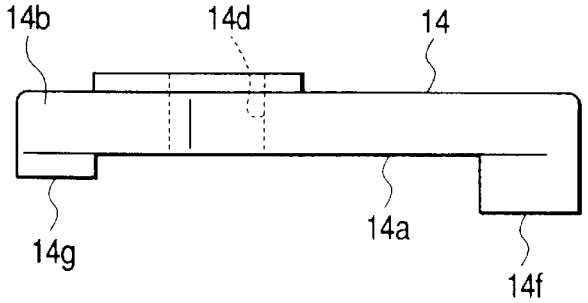
FIG. 9 is a plan view of the lever.

FIG. 8 is a front-elevational view of the lever 14, and FIG. 9 is a plan view of the lever 14. In FIGS. 8 and 9, the lever 14 includes an arm portion 14*a*. Claws 14*b* and 14*c*, defining forked shape, are formed integrally at a distal end of the arm portion 14*a*, i.e. the lever 14 is formed in Y-shaped, one end of the tines of Y-shape is the claw 14*c* and the other end of the tines is the claw 14*b*, and the base portion Y-shape is the arm portion 14*a*. An axis portion (rotation axis portion) 14*d*, defined by a through hole, is formed in the arm portion 14*a*. The support portions 21 are inserted into this axis portion 14*d*, so that the lever 14 is pivotally supported on the support portions 21. In this case, slanting surfaces 14*e* are formed at the forked portion of the lever 14 connecting the claws 14*b* and 14*c*. Slanting surfaces 21*a* (see FIG. 7) are formed respectively on head portions of the support portions 21 of the connector body 12. When inserting the lever 14 into the gap between the support portions 21, the slanting surfaces 14*e* are brought into sliding contact with the slanting surfaces 21*a*, respectively, so that the lever 14 can be inserted between the support portions 21 with a small force.

Figure 10:
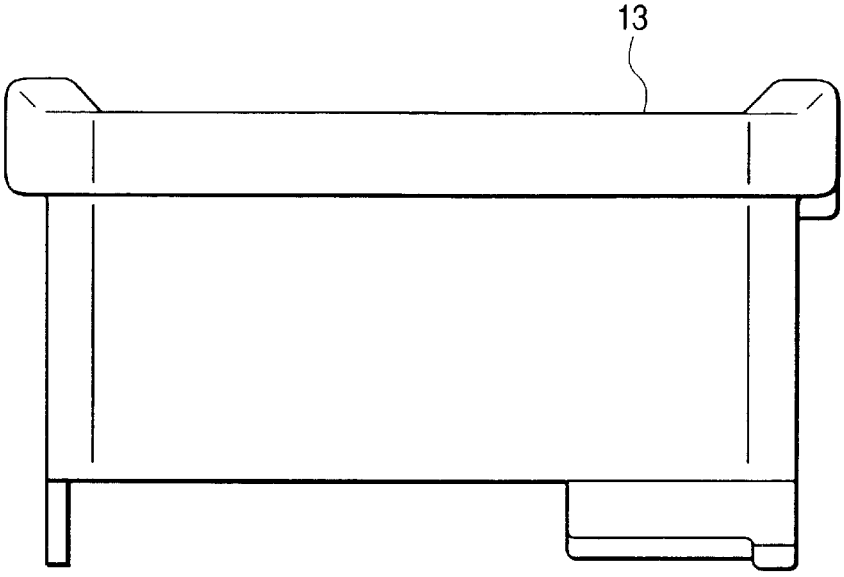
FIG. 10 is a front-elevational view of a slide member.
Figure 11:
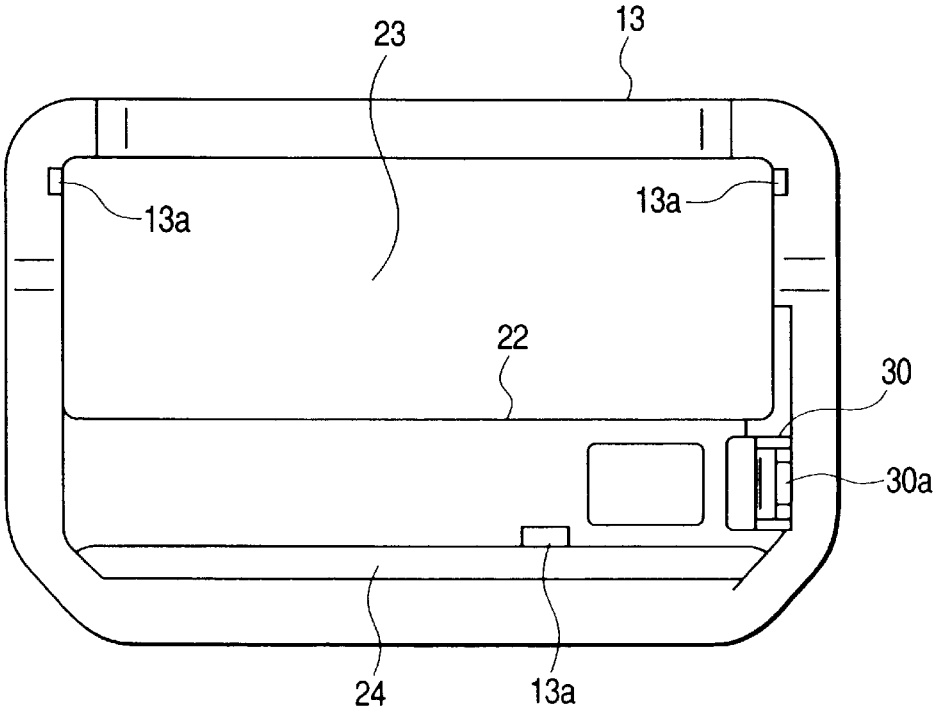
FIG. 11 is a plan view of the slide member.
Figure 12:
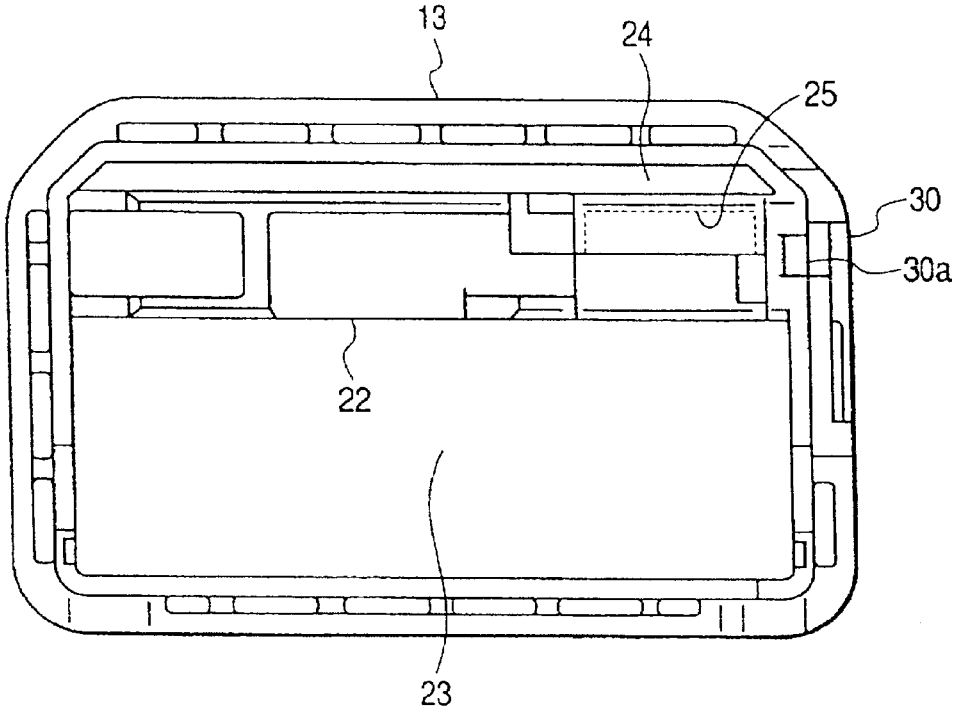
FIG. 12 is a bottom view of the slide member.
Figure 13:
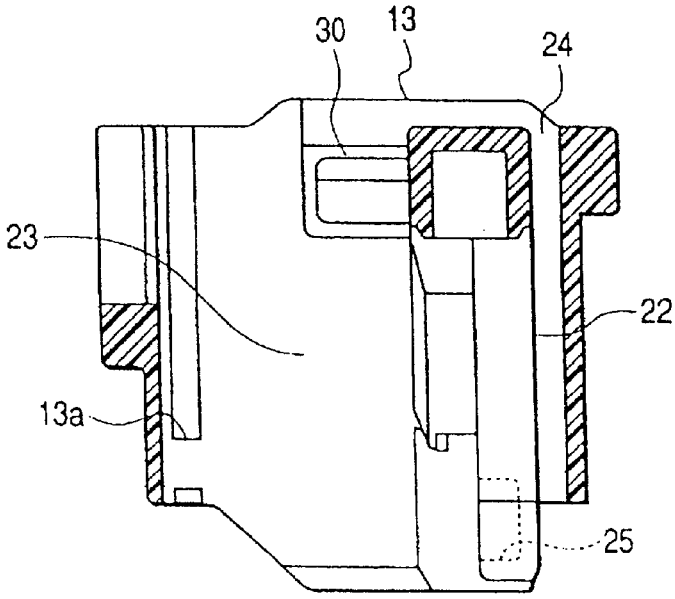
FIG. 13 is a vertical cross-sectional, left side-elevational view of the slide member.

FIG. 10 is a front-elevational view of the slide member 13, FIG. 11 is a plan view of the slide member 13, FIG. 12 is a bottom view of the slide member 13, and FIG. 13 is a vertical cross-sectional, left side-elevational view of the slide member 13. In FIGS. 10 to 13, the rectangular frame-like slide member 13 has a bridge portion 22 interconnecting opposite end walls thereof. An insertion space portion 23 is formed between the bridge portion 22 and one side wall of the slide member 13. A slit portion 24 is formed between the bridge portion 22 and the other side wall of the slide member 13. The terminal mounting portion 17 of the connector body 12 is inserted into the insertion space portion 23. The side wall portion 19 of the connector body 12 is inserted into the slit portion 24. In this case, a plurality of engagement grooves 13*a* are formed in the slide member 13, and a plurality of engagement claws 12*a* (see FIG. 2) are formed on the connector body 12. The engagement claws 12*a* are engaged respectively in the engagement grooves 13*a*, thereby preventing the slide member 13 from being disengaged from the connector body 12.

A slot 25 (see FIG. 2) is formed in the surface of the bridge portion 22 of the slide member 13 opposed to the insertion space portion 23. A boss 14*f* (see FIG. 8) of a circular shape, formed on the distal end of the arm portion 14*a* of the lever 14, is fitted in the slot 25 in the slide member 13. Therefore, when the slide member 13 slides relative to the connector body 12, the boss 14*f* of the lever 14 slides along the slot 25, so that the lever 14 is rotated or pivotally moved.

The lever 14 can be held by the connector body 12 so that the slide member 13 is kept in the completely drawn-out condition relative to the connector body 12. That is, an elastic arm portion 26 (see FIGS. 4 and 5) is formed integrally on the inner surface of the side wall portion 19 of the connector body 12. An engagement claw (corresponding to holding mechanism) 26*a* is formed at a distal end of the elastic arm portion 26. An engagement projection (corresponding to holding mechanism) 14*g* is formed on the claw 14*b* of the lever 14. The engagement projection 14*g* engages the engagement claw 26*a*, formed on the elastic arm portion 26, thereby limiting the pivotal movement of the lever 14 in a clockwise direction (see FIG. 1).

With this construction, when the slide member 13 is kept in the completely drawn-out condition relative to the connector body 12, the lever 14 is held in this position.

A groove-like portion 27 (see FIG. 6) is formed in the rear surface of the-connector body 12, and extends-across the terminal mounting portion 17. The terminal holder 15 is adapted to be mounted in this groove-like portion 27.

Figure 14:
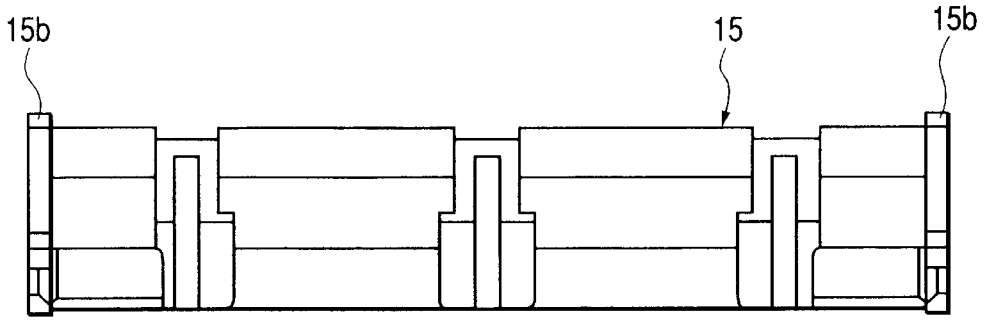
FIG. 14 is a front-elevational view of a terminal holder.
Figure 15:
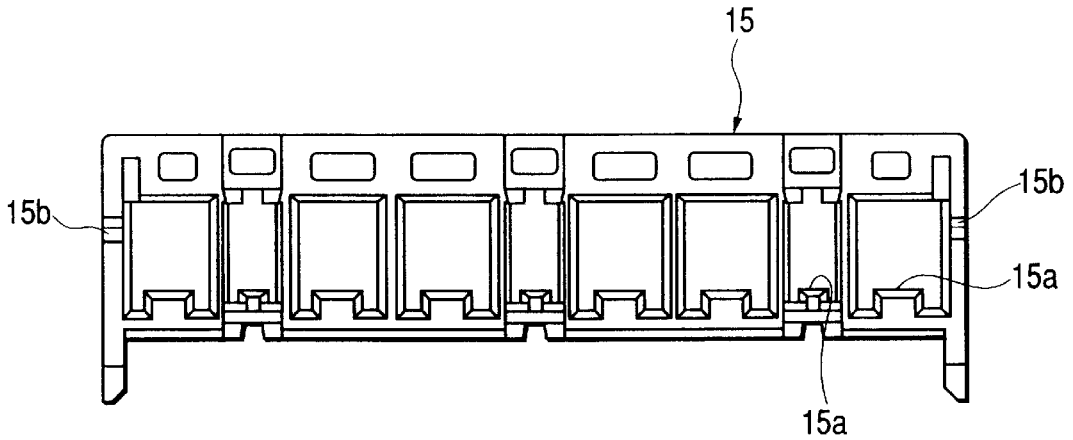
FIG. 15 is a plan view of the terminal holder.
Figure 16:
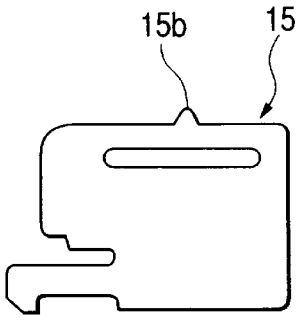
FIG. 16 is a side-elevational view of the terminal holder.
Figure 18:
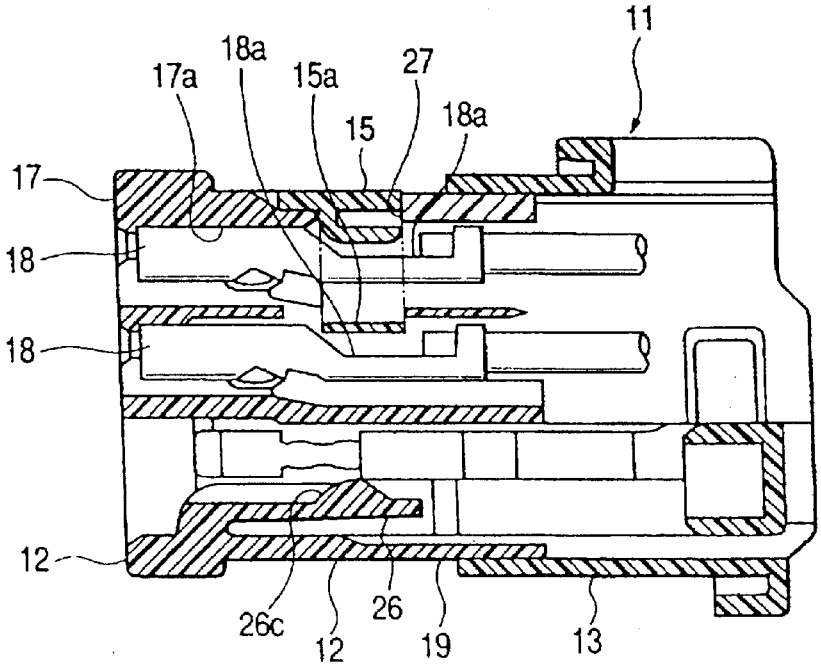
FIG. 18 is a cross-sectional, side-elevational view of the female connector, showing the terminal holder in a mounted condition.

FIG. 14 is a vertical cross-sectional, front-elevational view of the terminal holder 15, FIG. 15 is a plan view of the terminal holder 15, and FIG. 16 is a side-elevational view of the terminal holder 15. In FIGS. 14 to 16, a row of terminal guide holes 15*a* are formed in the terminal holder 15. When the terminal holder 15 is provisionally mounted in the groove-like portion 27 in the connector body 12, the terminal guide holes 15*a* function as part of the terminal insertion holes 17*a*, so that the female terminals 18 can be easily mounted in the terminal insertion holes 17*a*, respectively. Engagement arms 15*b* are formed at opposite ends of the terminal holder 15, respectively. When the terminal holder 15 is completely inserted into the groove-like portion 27, the engagement arms 15*b* are engaged respectively in engagement recesses (not shown) formed in the groove-like portion 27, thereby preventing the terminal holder 15 from withdrawal from the groove-like portion 27. In this case, when the terminal holder 15 is completely mounted in the groove-like portion 27, the terminal holder 15 is engaged in notch portions 18*a* of the female terminals 18, thereby preventing the withdrawal of these female terminals 18, as shown in FIG. 18.

The terminal holder 15 is asymmetrical with respect to the upper and lower sides thereof, and therefore the terminal holder 15 is prevented from being inserted into the groove-like portion 27 in an inverted (upside down) manner.

In FIGS. 1 and 2, the male connector 16 is formed integrally with the electric equipment (not shown). Male terminals 28, connected to this electric equipment, are mounted in a projected manner within the male connector 16. A plate-like engagement portion 29 is formed in a projected manner within the male connector, and is disposed adjacent to the male terminals 28. This engagement portion 29 can be inserted into the lever receiving chamber 20 formed in the female connector 11. A projection (corresponding to holding cancellation means) 29*a* is formed on a side surface of this engagement portion 29. When the engagement portion 29 enters the lever receiving portion 20 in the female connector 11, the projection 29*a* slides along a groove portion 26*b* (see FIG. 21) formed at the elastic arm portion 26. In this case, a convex portion (corresponding to holding cancellation means) 26*c* (see FIG. 21) is formed at a distal end of the groove portion 26*b,* and the projection 29*a,* moved along the groove portion 26, slides over the convex portion 26*c,* thereby elastically. deforming the elastic arm portion 26 away from the lever 14.

A tongue portion 29*b* is formed at the distal end of the engagement portion 29. The claws 14*b* and 14*c* of the lever 14 can be engaged with this tongue portion 29*b* in a manner described later.

An elastic arm portion 30 is formed on the slide member 13, and an engagement projection 30*a* is formed on this elastic arm portion 30. An engagement claw 31 is formed on the male connector 16. When the female connector 11 is completely mounted in the male connector 16, the engagement claw 31 engages the engagement projection 30*a* of the elastic arm portion 30.

Next, the operation of the above construction will be described.

Figure 17:
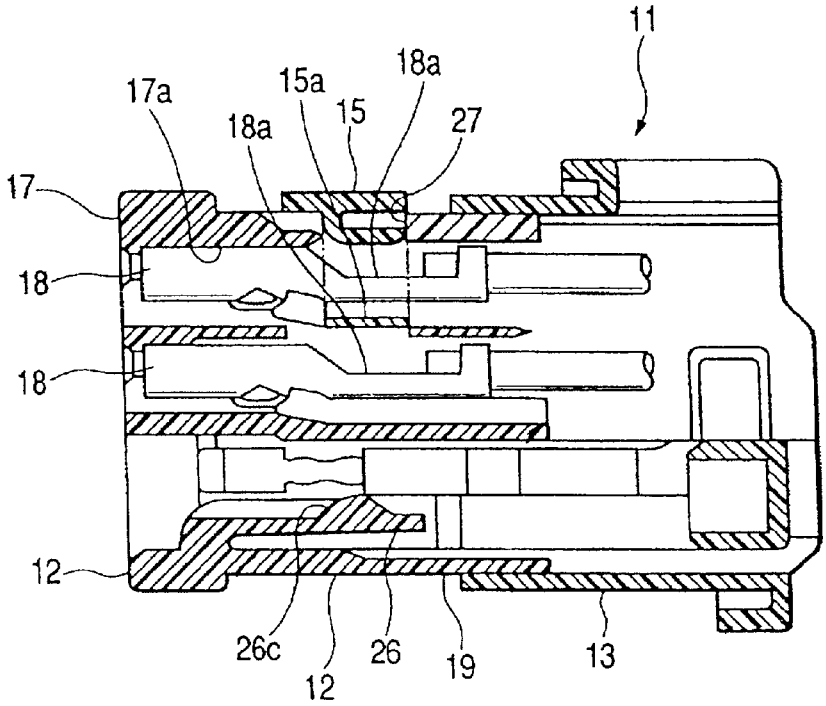
FIG. 17 is a cross-sectional, side-elevational view of the female connector, showing the terminal holder in a provisionally-mounted condition.

First, the terminal holder 15 is provisionally mounted in the groove-like portion 27 in the female connector 11 by the user. In this condition, the female terminals 18 connected to the cable are inserted respectively into the terminal insertion holes 17*a* in the terminal mounting portion 17, as shown in FIG. 17. At this time, the terminal guide holes 15*a* in the terminal holder 15, provisionally mounted in the groove-like portion 27, function as part of the terminal insertion holes 17*a* and therefore the female terminals 18 can be easily inserted into the respective terminal insertion holes 17*a*.

Then, when the terminal holder 15 is completely pushed into the groove-like portion 27, this terminal holder 15 is mounted in the connector body 12 against withdrawal therefrom. At this time, the terminal holder 15 retains the female terminals 18, and therefore the female terminals 18 are prevented from withdrawal. In this case, if the terminal holder 15 is incompletely pushed into the groove-like portion 27, and therefore is projected outwardly from this groove-like portion 27, the terminal holder 15 is disposed in a path of movement of the slide member 13 when the slide member 13 is fitted on the connector body 12. Therefore the projected terminal holder 15 limits this movement of the slide member 13, and as a result, this incompletely-mounted condition of the terminal holder 15 can be detected, and can be dealt with.

For mounting the female connector 11 in the male connector 16, the female connector 11 is positioned relative to the male connector 16, and the slide member 13 of the female connector 11 is pushed toward the male connector 16.

Figure 19:
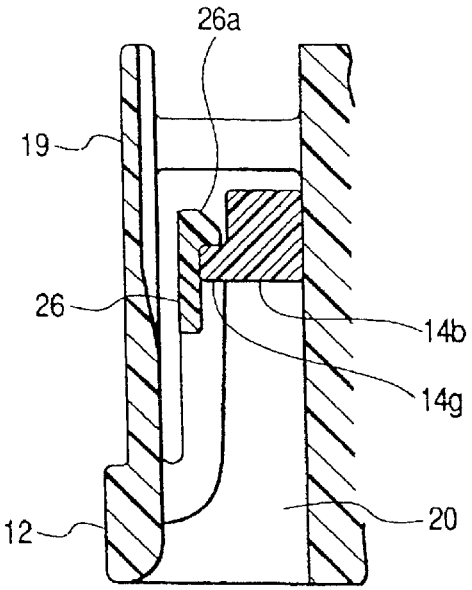
FIG. 19 is a cross-sectional view of an important portion of the connector body, showing the lever in a retained condition.
Figure 20:
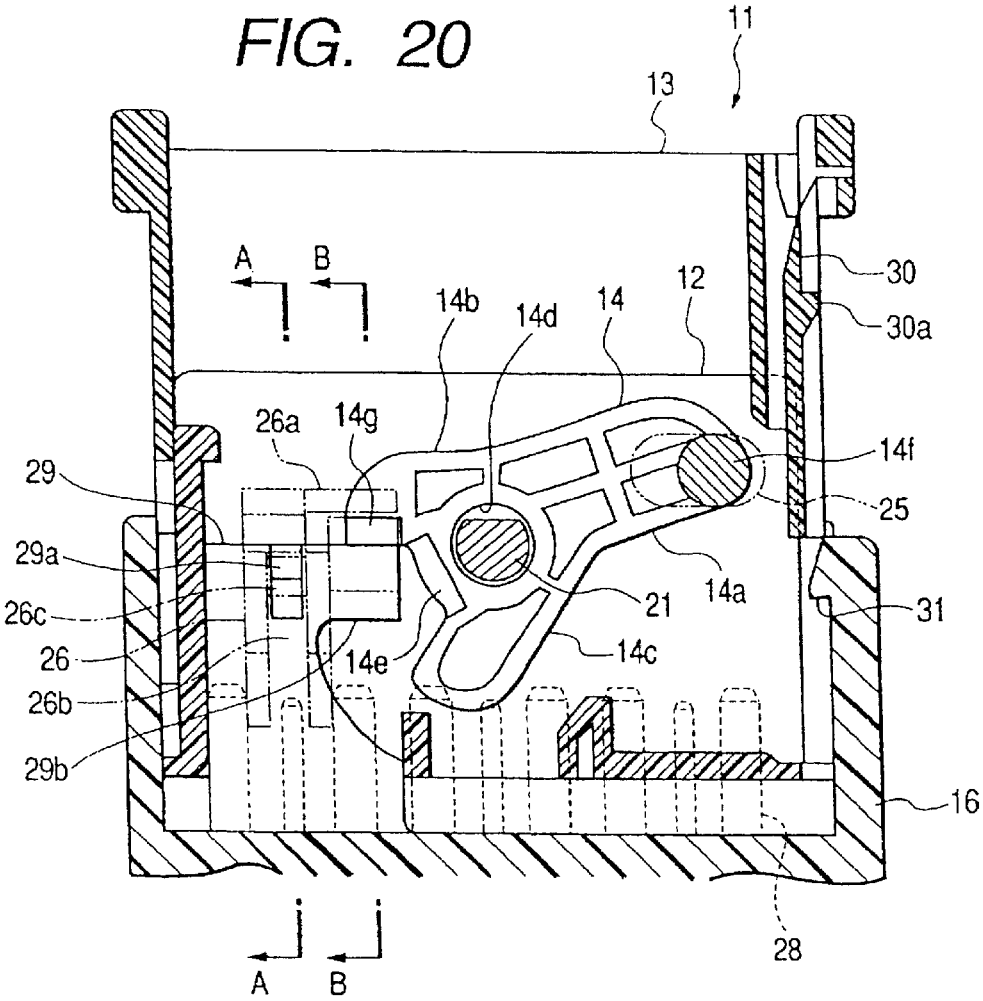
FIG. 20 is a vertical cross-sectional, front-elevational view of the connector, showing a condition immediately before the initiation of the interconnection.
Figure 21:
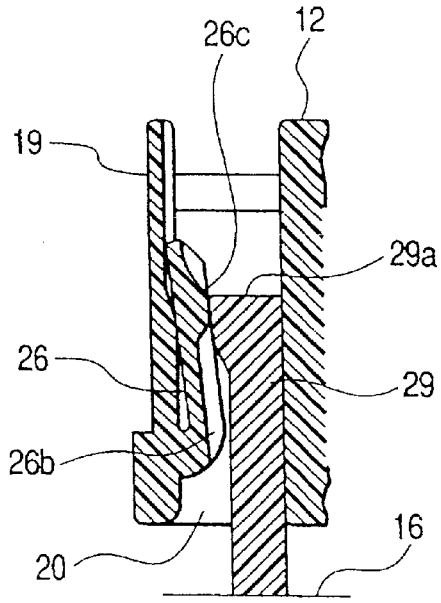
FIG. 21 is a cross-sectional view taken along the line A—A of FIG. 20.
Figure 22:
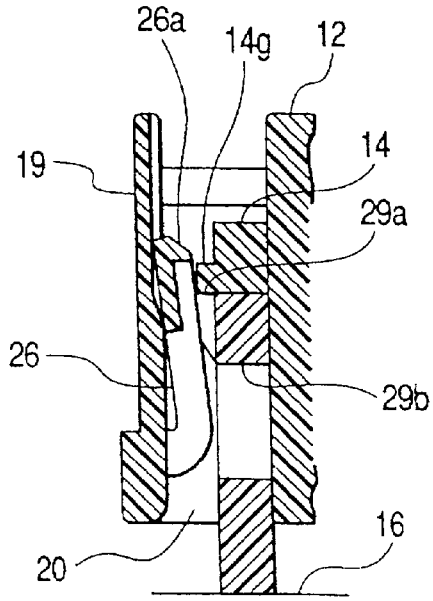
FIG. 22 is a cross-sectional view taken along the line B—B of FIG. 20.
Figure 23:
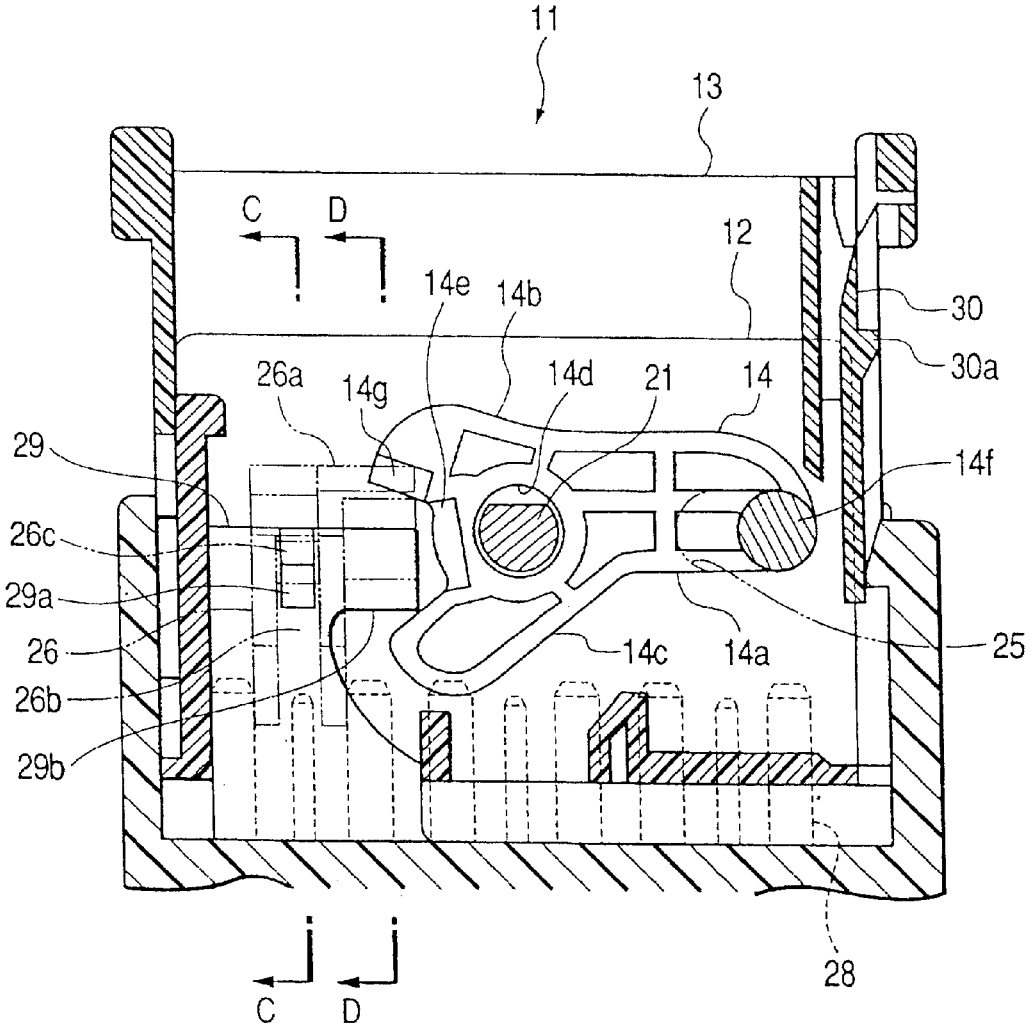
FIG. 23 is a vertical cross-sectional, front-elevational view of the connector in an interconnection-started condition.
Figure 24:
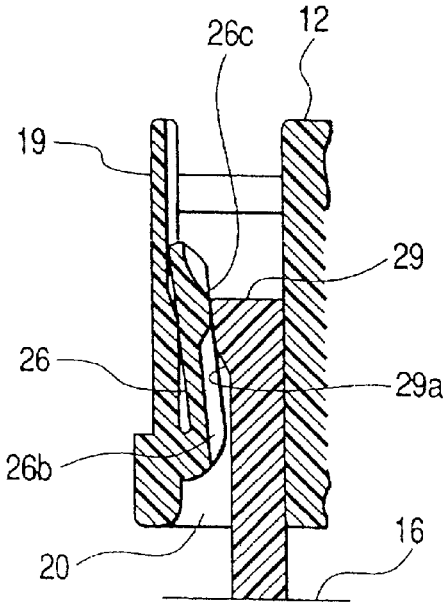
FIG. 24 is a cross-sectional view taken along the line C—C of FIG. 23.
Figure 25:
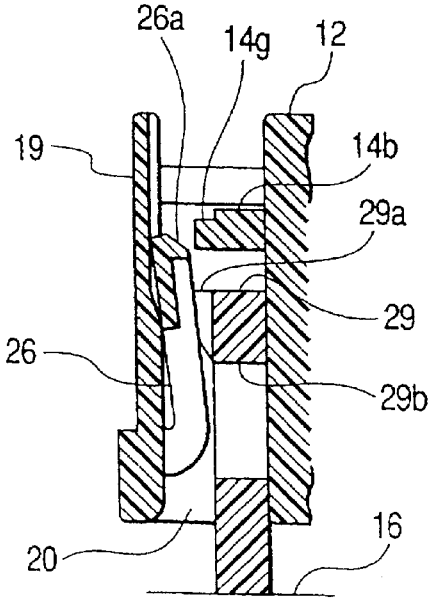
FIG. 25 is a cross-sectional view taken along the line D—D of FIG. 23.

At this time, the claw 14*b* of the lever 14 is engaged with the engagement claw 26*a* of the elastic arm portion of the connector body 12 as shown in FIG. 19, and therefore the pivotal movement of the lever 14 and hence the sliding operation of the slide member 13 are inhibited.

As the male connector 16 is fitted on the female connector 11, the projection 29*a* formed on the engagement portion 29 of the male connector 16 moves sequentially over the groove portion 26*b* of the elastic arm portion 26 and the convex portion 26*c*. Therefore, the convex portion 26*c* is pressed by the projection 29*a,* so that the elastic arm portion 26 is elastically deformed. As a result, the retaining of the lever 14 by the elastic arm portion 26 is canceled, so that the lever 14 is allowed to be pivotally moved (see FIGS. 20 to 22).

When the slide member 13 is pushed to be fitted the connector body 12 in this pivotally-movable condition of the lever 14, the lever 14 is pivotally moved in the clockwise direction (FIG. 20) in accordance with the sliding movement of the slide member 13. As a result, the claw 14*c* of the lever 14 is roundly brought into engagement with the tongue portion 29*b* of the engagement portion 29 formed on the male connector 16 (see FIGS. 23 to 25).

Figure 26:
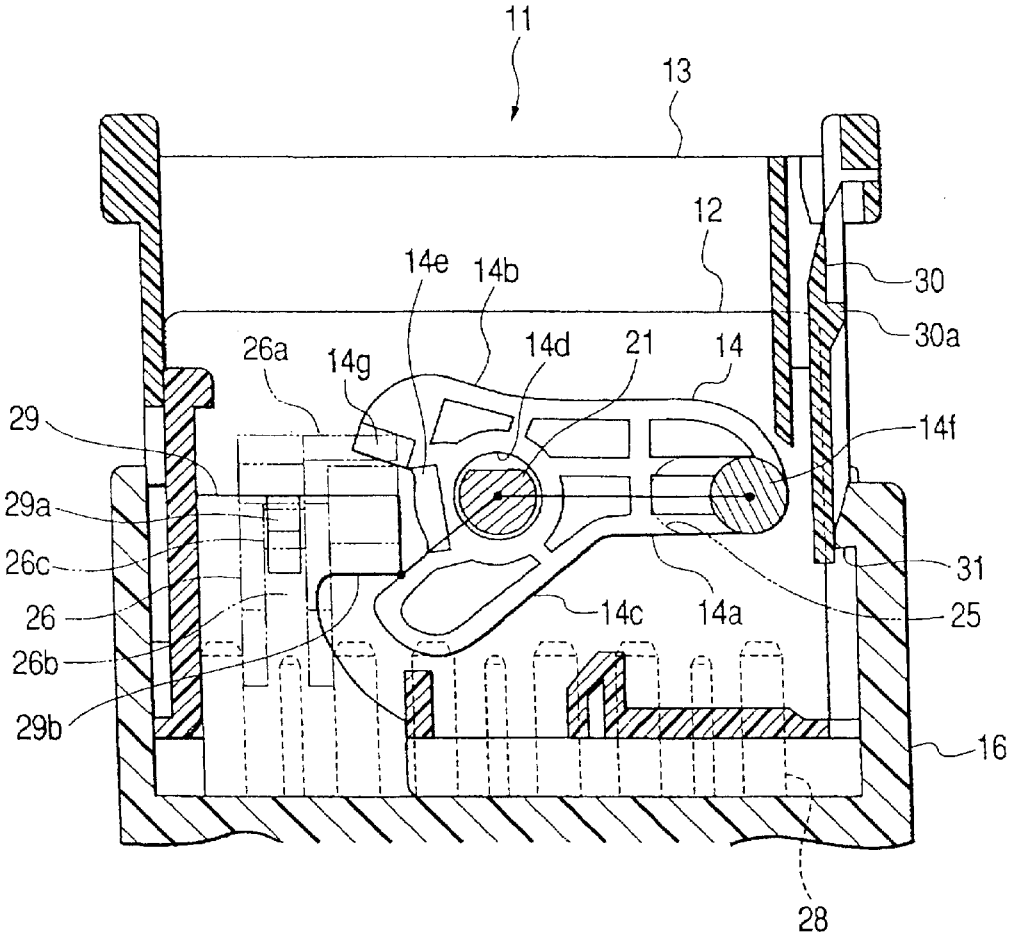
FIG. 26 is a vertical cross-sectional, front-elevational view of the connector, showing the relation of forces in the interconnection-started condition.
Figure 27:
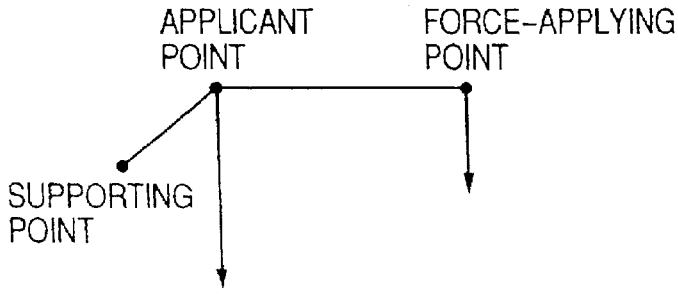
FIG. 27 is a diagram showing the relation of acting of the forces.
Figure 28:
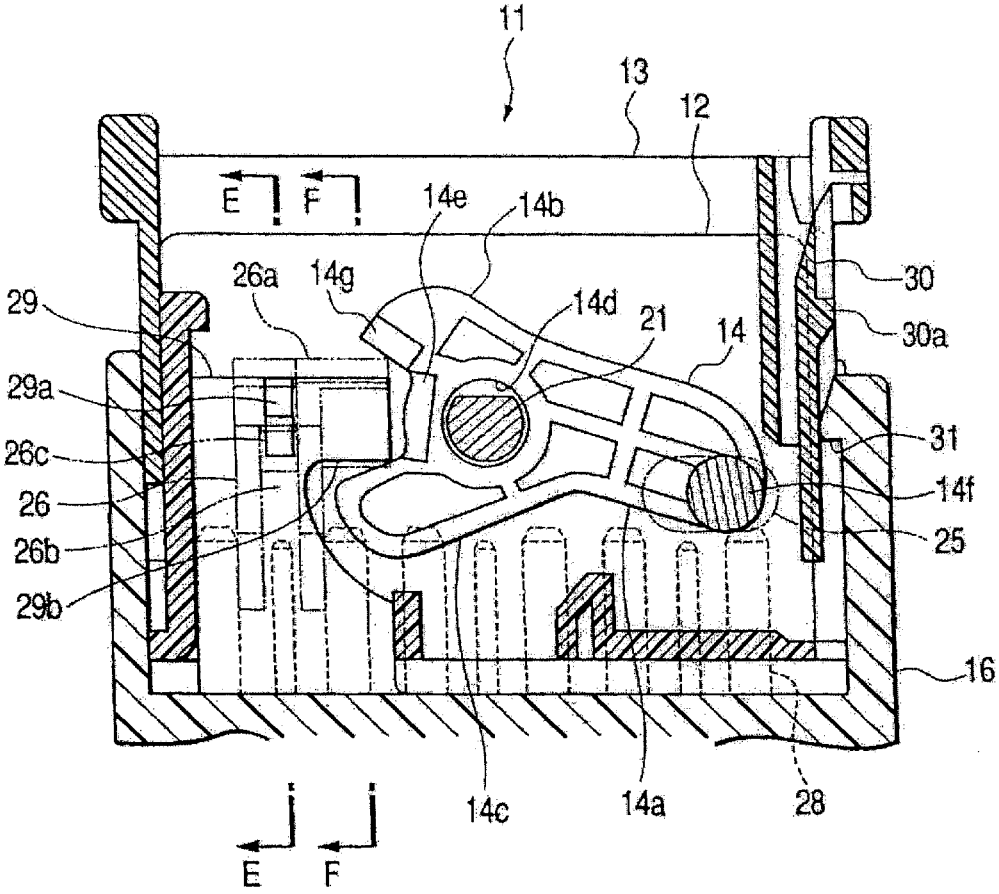
FIG. 28 is a vertical cross-sectional, front-elevational view of the connector during the interconnection-starting operation.
Figure 29:
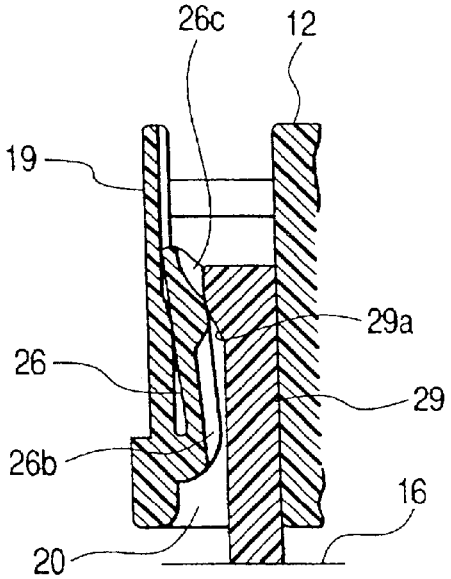
FIG. 29 is a cross-sectional view taken along the line E—E of FIG. 28.
Figure 30:
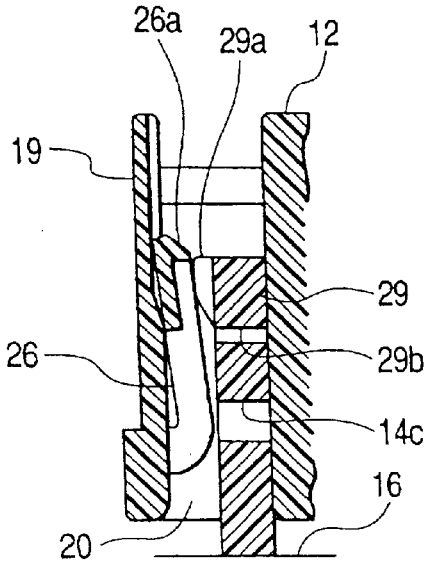
FIG. 30 is a cross-sectional view taken along the line F—F of FIG. 28.

When the slide member 13 is further pushed to be fitted on the connector body 12, the principle of leverage is applied to this action. That is, the claw 14*c* of the lever 14, held in contact with the tongue portion 29*b* of the engagement portion 29, serves as a supporting point, the axis portion 14*d* of the lever 14 serves as an application point, and the boss 14*f* connected to the slide member 13 serves as a force-applying point as shown in FIGS. 26 and 27. Therefore, The force applied from the slide member 13 to the arm portion 14*a* of the lever 14 is amplified and acts on the axis portion 14*d* of the lever 14. As a result, the amplified pushing force applied to the lever 14 acts on the connector body 12 connected to the axis portion 14*d* of the lever 15. Therefore, the male terminal 28 are inserted respectively into the female terminals 18 with a pushing force larger than the pushing force applied to the slide member 13. Namely, the pushing force, applied to the slide member 13, can be converted into the large pushing force with which the female connector 11 is inserted into the male connector 16 in accordance with the operation of the lever 14. Therefore, the female connector 11 can be inserted into the male connector 16 by applying the small pushing force to the slide member 13 (see FIGS. 28 to 30).

Then, when the slide member 13 is completely pushed to be fully fitted on the connector body 12, the lever 14 is pivotally moved into a rotation finish position, so that the female connector 11 is completely connected to the male connector 16. At this time, the engagement claw 31, formed on the male connector 16, is engaged with the engagement projection 30*a* formed on the elastic arm portion 30 formed on the female connector 11. Therefore the female connector 11 is connected to the male connector 16 against withdrawal therefrom (see FIGS. 31 to 33).

It is to be noted that when the claw 14*c* of the lever 14 begins to engage the tongue portion 29*b* of the engagement portion 29 as shown in FIG. 26, the arm portion 14*a* (serving as the force-applying point) of the lever 14 which receives the force from the slide member 13 is disposed generally perpendicularly to the direction of sliding of the slide member 13, as shown in FIG. 26, so that the pushing force applied to the lever 14 from the slide member 13 can be amplified to a maximum. Namely, in the case where the number of the terminals mounted in each connector is large, a very large force is required at an initial stage of the interconnection of the terminals. Therefore, the arrangement is so made that the pushing force applied to the lever 14 from the slide member 13 can become maximum at the time of starting this interconnecting operation, and by doing so, thereafter, the male connector 16 can be connected to the female connector 11 with the small pushing force.

When the slide member 13 is completely pushed to be fully fitted on the connector body 12, the terminal holder 15 is covered with the slide member 13, and therefore the terminal holder 15 is prevented from withdrawal, and the female terminals 18 are prevented from being drawn respectively from the terminal insertion holes 17*a* in the female connector 11.

When the female connector 11 is completely mounted in the male connector 16, the elastic arm portion 26 on the female connector 11 is restored from the elastically-deformed condition into the original configuration. Thus the elastic arm portion 26 is not kept in the elastically-deformed condition for a long period of time, and therefore is prevented from aging deterioration.

Figure 31:
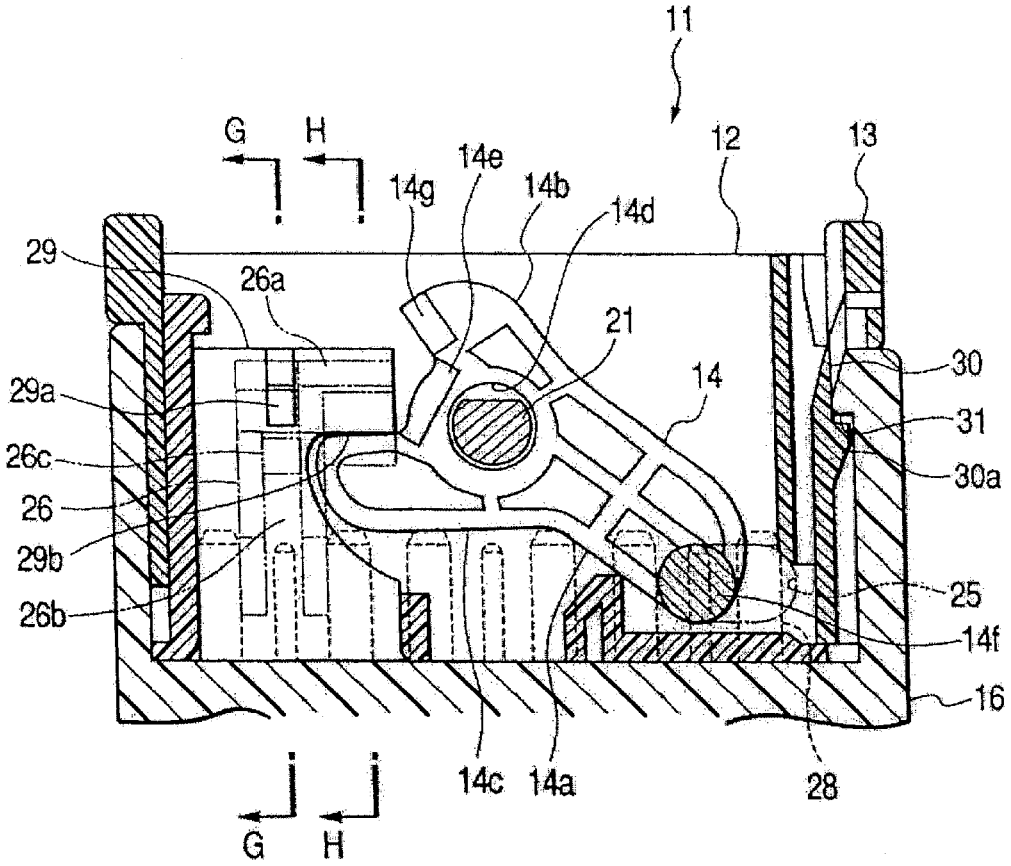
FIG. 31 is a vertical cross-sectional, front-elevational view of the connector in an interconnection-finished condition.
Figure 32:
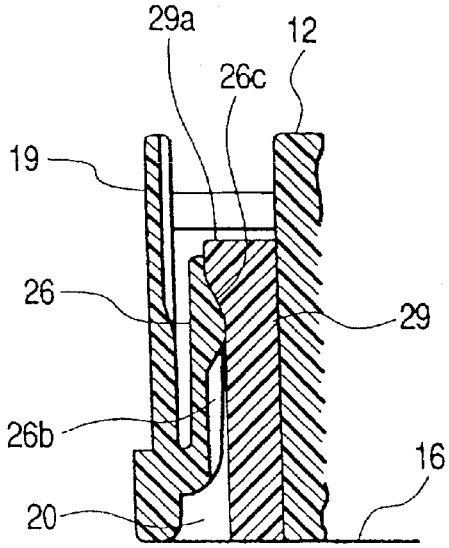
FIG. 32 is a cross-sectional view taken along the line G—G of FIG. 31.
Figure 33:
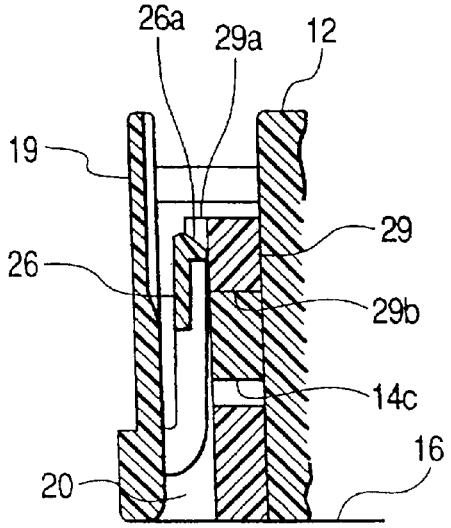
FIG. 33 is a cross-sectional view taken along the line H—H of FIG. 31.

For disconnecting the female connector 11 from the male connector 16, the elastic arm portion 30 of the slide member 13 is pushed inwardly, and in this condition the slide member 13 is drawn from the connector body 12. Therefore, the retaining of the slide member 13 of the female connector 11 by the male connector 16 is canceled. In this canceled condition, the arm portion 14*a* of the lever 14 is pulled by the slide member 13, so that the lever 14 is pivotally moved in a counterclockwise direction (FIG. 31).

Figure 34:
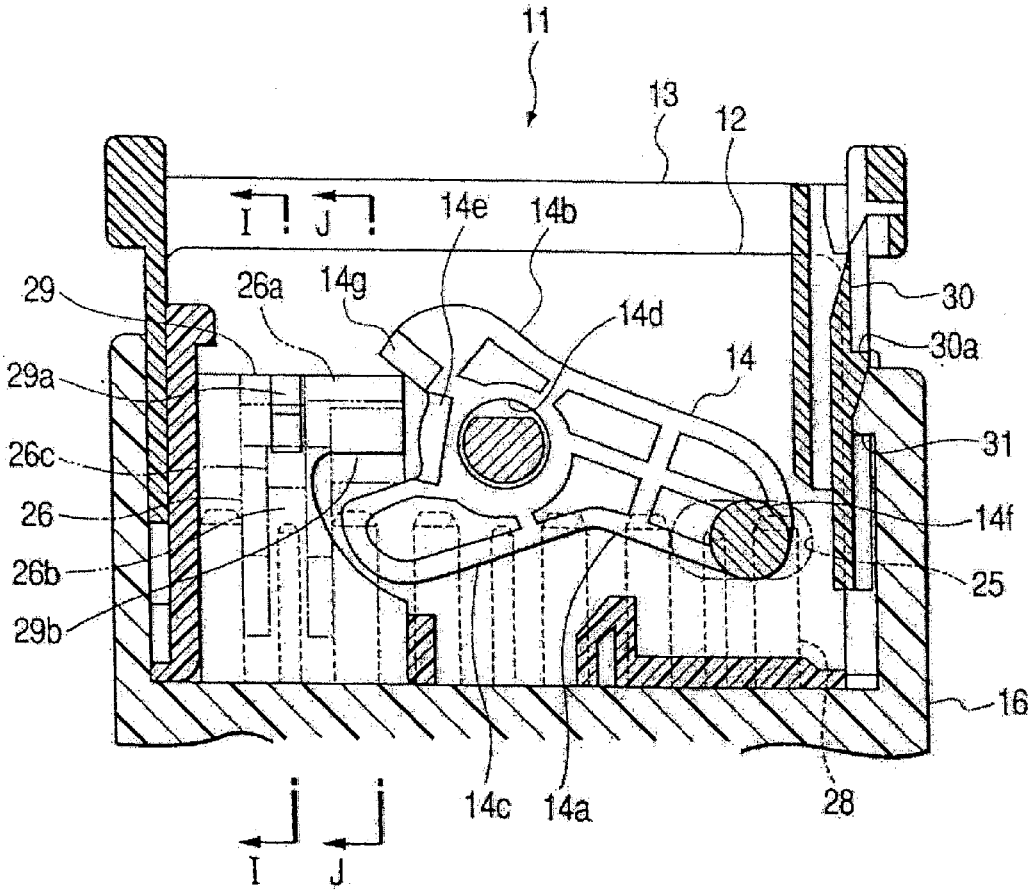
FIG. 34 is a vertical cross-sectional, front-elevational view of the connector in an interconnection cancellation-started condition.
Figure 35:
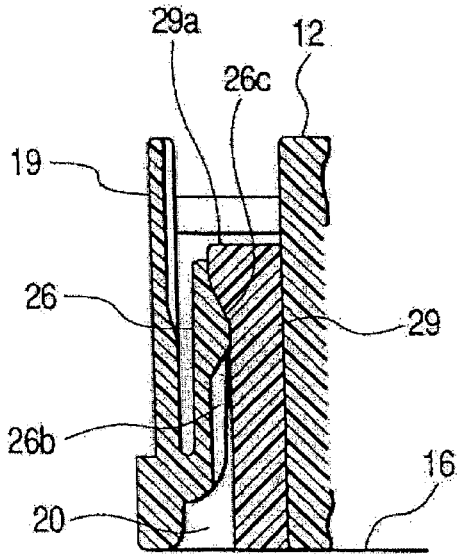
FIG. 35 is a cross-sectional view taken along the line I—I of FIG. 34.
Figure 36:
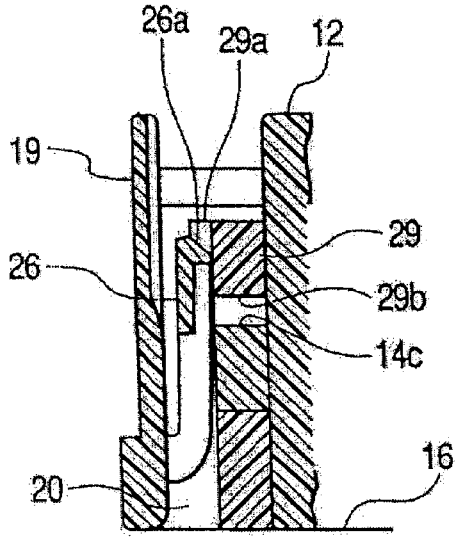
FIG. 36 is a cross-sectional view taken along the line J—J of FIG. 34.
Figure 37:
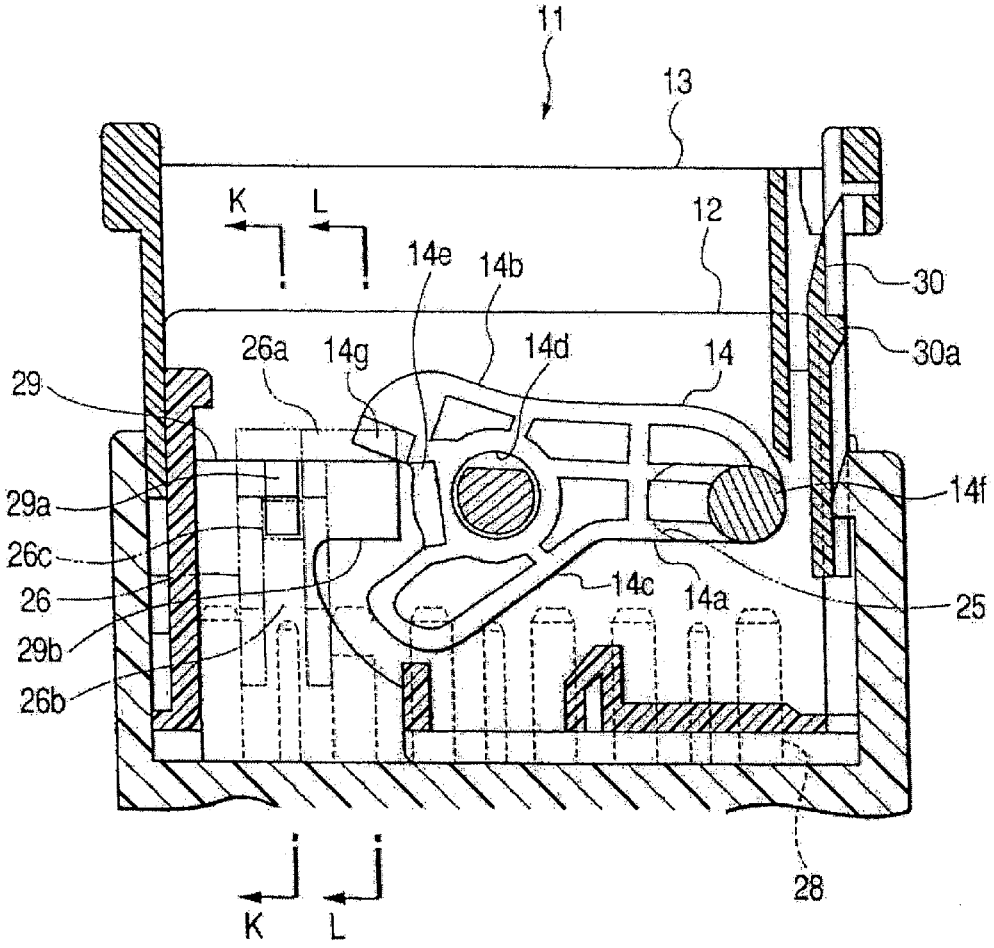
FIG. 37 is a vertical cross-sectional, front-elevational view of the connector during the interconnection cancellation-starting operation.
Figure 38:
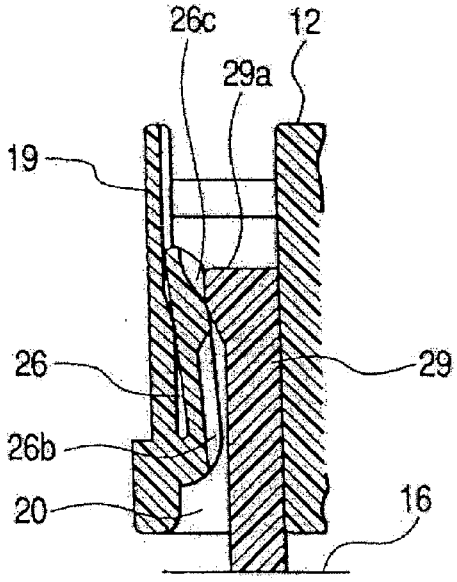
FIG. 38 is a cross-sectional view taken along the line K—K of FIG. 37.
Figure 39:
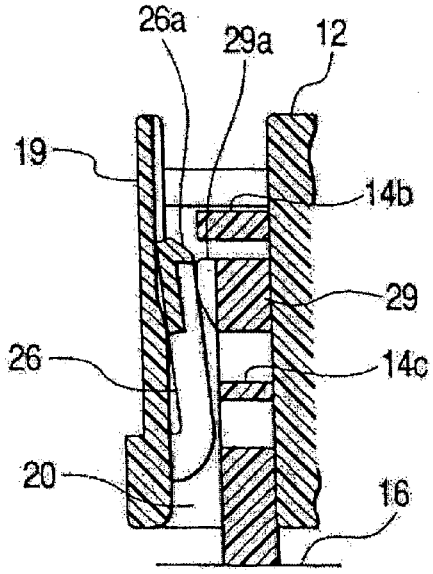
FIG. 39 is a cross-sectional view taken along the line L—L of FIG. 37.
Figure 40:
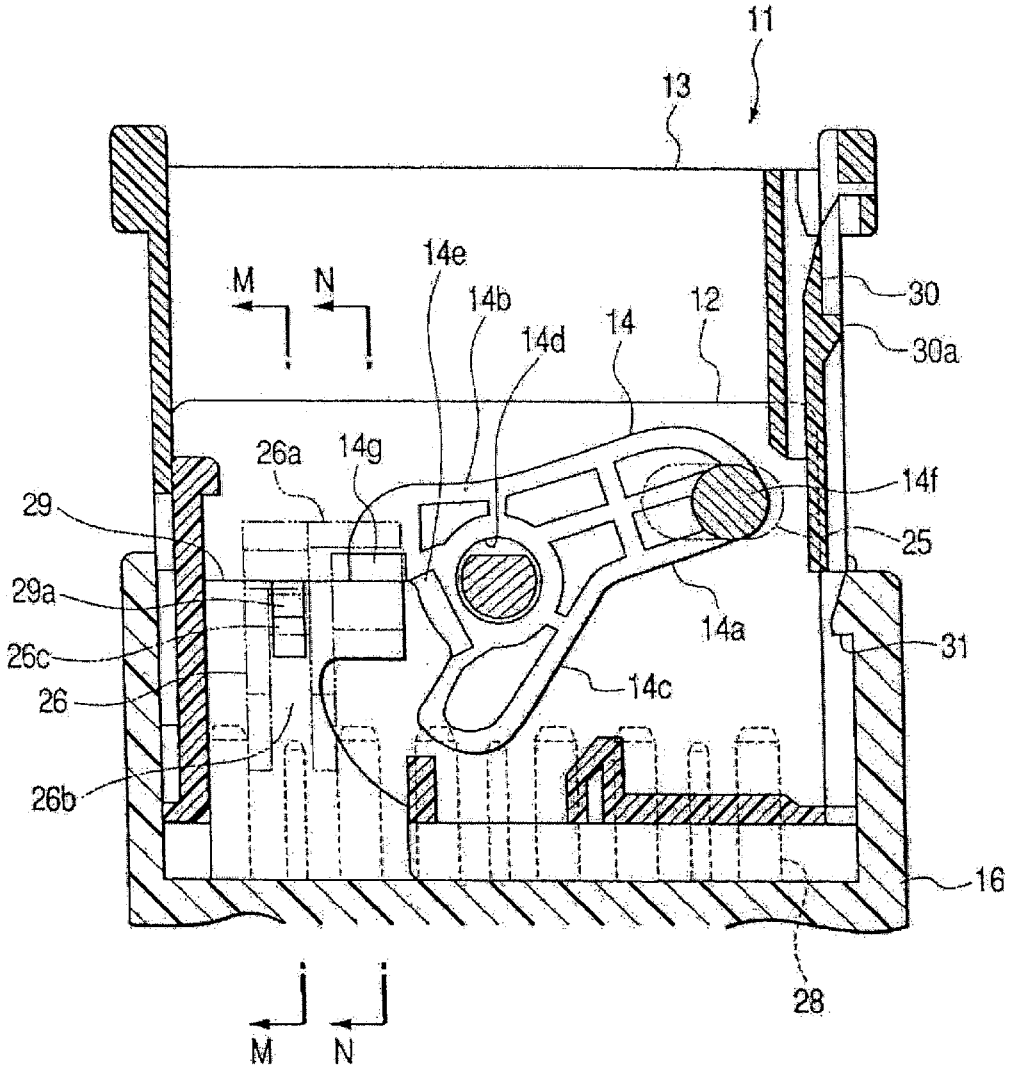
FIG. 40 is a vertical cross-sectional, front-elevational view of the connector in an interconnection cancellation-finished condition.
Figure 41:
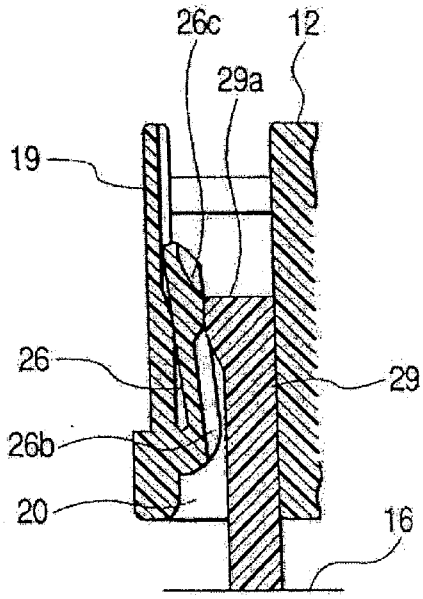
FIG. 41 is a cross-sectional view taken along the line M—M of FIG. 40.
Figure 42:
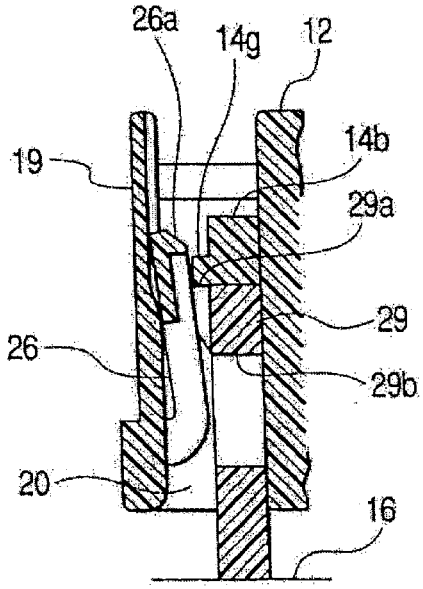
FIG. 42 is a cross-sectional view taken along the line N—N of FIG. 40.
Figure 43:
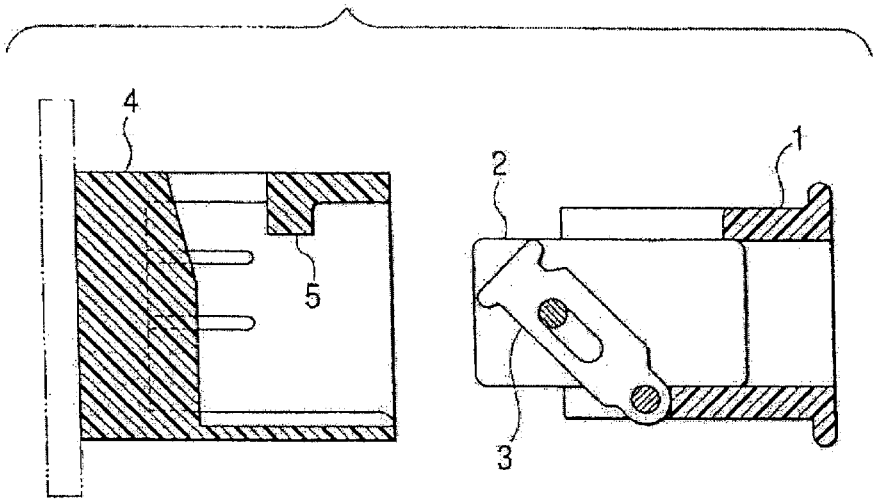
FIG. 43 RELATED ART
FIG. 43 is a cross-sectional view of a conventional connector.
Figure 44:
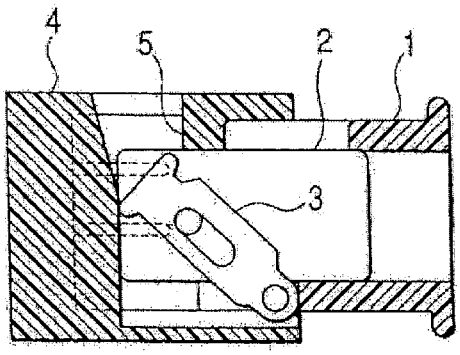
FIG. 44 RELATED ART
FIG. 44 is a cross-sectional view of the connector in a connector interconnection-started condition.
Figure 45:
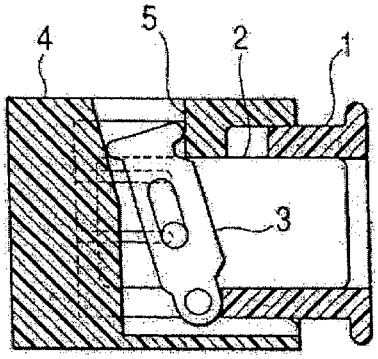
FIG. 45 RELATED ART
FIG. 45 is a cross-sectional view of the connector during the connector-interconnecting operation.
Figure 46:
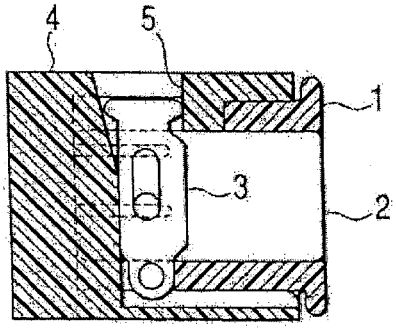
FIG. 46 RELATED ART
FIG. 46 is a cross-sectional view of the connector in a connector interconnection-finished condition.

At this time, the lever 14 idles a predetermined angle from the rotation finish position (shown in FIG. 31), and then the claw 14*b* of the lever 14 is vigorously brought into engagement with the tongue portion 29*b* of the engagement portion 29 formed on the male connector 16 (see FIGS. 34 to 36).

When the slide member 13 is further draw, the draw force applied to the slide member 13 is amplified because of the leverage, and serves as a draw force for drawing the connector body 12, in which case the claw 14*b* of the lever 14 serves as a supporting point, and the axis portion 14*d* of the lever 14 serves as an application point, and the boss 14*f*, connected to the slide member 13, serves as a force-applying point. As a result, the small pulling force applied to the slide member 13 can be converted into the large draw force for drawing the female connector 11 from the male connector 16. Therefore the female connector 11 can be easily disconnected from the male connector 16.

At the time when the engagement projection 14*g* formed on the lever 14 is passed through the engagement claw 26*a* on the elastic arm portion 26 during the pivotal movement of the lever 14, the elastic arm portion 26 is elastically deformed by the projection 29*a* of the engagement portion 29 formed on the male connector 16. Therefore, the lever 14 can be pivotally moved without being caught by the elastic arm portion 26 (see FIGS. 37 to 39).

Then, when the slide member 13 is completely drawn out relative to the connector body 12, the female connector 11 is disconnected from the male connector 16. At this time, the engagement portion 29 on the male connector 16 is disengaged from the elastic arm portion 26 on the female connector 11, so that the elastic arm portion 26 is restored into the original condition, and therefore the lever 14 is held in the rotation start position (see FIGS. 40 to 42).

In this embodiment, the force required, for inserting and drawing the female connector 11 relative to the male connector 16, is reduced by utilizing the lever 14. The lever 14 is held in the rotation start position, with the slide member 13 kept in the completely drawn-out condition relative to the connector body 12, and When the female connector 11 is to be inserted into and drawn from the male connector 16, this held condition is cancelled. Therefore, when the female connector 11 is to be inserted into and drawn from the male connector 16, this operation can be effected merely by holding the slide member 13 of the female connector 11 with the hand. Therefore, unlike a construction in which the force for inserting and drawing two connectors relative to each other is merely reduced by utilizing a lever, the female connector 11 can be easily inserted into and drawn from the male connector 16.

At the time when the female connector 11 begins to be inserted into the male connector 16, the axis of pivotal movement of the lever 14 and the force-applying point of the lever 14 (at which the force is applied to the lever 14 from the slide member 13 of the female connector 11) are disposed on a line generally perpendicular to the direction of sliding of the slide member 13. With this construction, the force of insertion of the female connector 11 into the male connector 16 by the lever 14 is made maximum. Therefore the two connectors can be connected together more efficiently as compared with a construction in which the inserting-drawing force, applied by a lever, becomes maximum midway during the connection of the two connectors.

The slanting surfaces 14*e* are formed at the forked portion of the lever 14, connecting the claws 14*b* and 14*c*, so that the lever 14 can be mounted on the female connector 11 with a reduced mounting force. Therefore, the operation for mounting the lever 14 can be effected easily.

When the lever 14 is pivotally moved in accordance with the sliding movement of the slide member 13, the lever 14 is first pivotally moved through the predetermined angle, and then is brought into engagement with the engagement portion 29 of the male connector 16. Therefore the lever 14 is vigorously brought into engagement with the engagement portion 29, thereby facilitating the connection of the two connectors to each other.

When the terminal holder 15 for retaining the female terminals, mounted respectively in the terminal insertion holes 17*a* in the female connector 11, is not completely inserted in the connector body 12, but is projected outwardly therefrom, the slide member 13 can not be slid relative to the connector body 12. With this construction, the female terminals 18 can be positively retained by the terminal holder 15. In this case, when the female connector 11 is completely mounted in the male connector 16, the terminal holder 15 is covered with the slide member 13, and therefore the withdrawal of the terminal holder 15 is positively prevented by the slide member 13.

The present invention is not limited to the above embodiment, and the following modifications and expansions.

A slide member may be mounted on the male connector, in which case the two connectors are connected together by the force of rotation of the lever obtained when the male connector is pressed against the female connector.

The female connector maybe of the cable-connection type.

As is clear from the foregoing description, in the connector-interconnecting device of the present invention, the two connectors are connected together, utilizing the pivotal movement of the lever effected in accordance with the sliding movement of the slide member, and in this construction, the lever is held in the predetermined position, with the slide member kept in the completely drawn-out condition relative to the connector, and when the two connectors are to be connected together, this held condition of the lever is cancelled. Therefore, there is achieved an advantageous effect that the operation for connecting the two connectors together can be effected easily.

What is claimed is:

1. A connector connecting device comprising:

a first connector;

a slide member slidably mounted on said first connector;

a lever pivotally mounted on said first connector, and being rotatable in accordance with a slide movement of said slide member;

a second connector connectable with said first connector including an engagement portion engagement with said lever;

a holding mechanism which holds said lever by engagement with said first connector when said slide member is kept in a drawn-out condition relative to said second connector;

where the slide member slides in a direction substantially parallel to the direction in which the first connector is connected to the second connector, and wherein an inserting-drawing force acting between said first and second connectors is reduced by an operating force, wherein said operating force is applied to said slide member and is converted into a rotational force of said lever.

2. A connector connecting device according to claim 1, wherein said second connector includes a holding cancellation member for canceling said engagement of said lever when said first connector is inserted into or drawn from said second connector.

3. A connector connecting device according to claim 1, wherein a line, which connects an axis of said lever and a force-applying point of said lever at which a force is applied to said lever from said slide member, is disposed substantially perpendicular to a slide direction of said slide member when said lever begins to engage with said engagement portion.

4. A connector connecting device according to claim 1, wherein said first connector includes a pair of support portions, spaced a predetermined distance from each other, for pivotally movably supporting said lever disposed between said pair of support portions, said lever includes slanting surfaces brought into sliding contact with peripheral edges of head portions of said support portions when said lever is inserted into a gap between said support portions.

5. A connector connecting device according to claim 1, wherein said lever is engaged with said engagement portion when said lever is pivotally moved a predetermined angle from a rotation start position in accordance with said slide movement.

6. A connector connecting device according to claim 1 further comprising a terminal holder mounted on said first connector to prevent a terminal from being withdrawn from said first connector, wherein said terminal holder projects into a path of said slide movement when said terminal holder is incompletely mounted on said first connector.

7. A connector connecting device according to claim 1, wherein said first connector is one of a female connector and a male connector, said second connector is the other of said female connector and said male connector.

8. A connector connecting device comprising:

a first connector;

a slide member slidably mounted on said first connector;

a lever formed in Y-shape defining two tines and a base portion, pivotally mounted on said first connector through a center portion where said tines are connected to said base portion, and being rotatable in accordance with a slide movement of said slide member; and a second connector connectable with said first connector including an engagement portion engagement with said lever;

where one end of said tines is engaged with said engagement portion when said first connector is inserted in said second connector, the other end of said tines is engaged with said engagement portion when said first connector is drawn from said second connector, said base portion receives a force applied from said slide member, where the slide member slides in a direction substantially parallel to the direction in which the first connector is connected to the second connector, and wherein an inserting-drawing force acting between said first and second connectors is reduced by an operating force, wherein said operating force is applied to said slide member and is converted into a rotational force of said lever.

9. A connector connecting device according to claim 8, wherein said engagement portion is projected from said second connector in a direction perpendicular to a slide direction of said slide member and defines a lower surface engaged with said one end of said tines when said first connector is inserted in said second connector and an upper surface engaged with the other end of said tines when said first connector is drawn from said second connector.

10. A connector connecting device according to claim 8, wherein a line, which connects an axis of said lever and a force-applying point of said lever at which a force is applied to said lever from said slide member, is disposed substantially perpendicular to a slide direction of said slide member when said lever begins to engage with said engagement portion.

11. A connector connecting device according to claim 8, wherein said first connector includes a pair of support portions, spaced a predetermined distance from each other, for pivotally movably supporting said lever disposed between said pair of support portions, said lever includes slanting surfaces brought into sliding contact with peripheral edges of head portions of said support portions when said lever is inserted into a gap between said support portions.

12. A connector connecting device according to claim 8, wherein said lever is engaged with said engagement portion when said lever is pivotally moved a predetermined angle from a rotation start position in accordance with said slide movement.

13. A connector connecting device according to claim 8 further comprising a terminal holder mounted on said first connector to prevent a terminal from being withdrawn from said first connector, wherein said terminal holder projects into a path of said slide movement when said terminal holder is incompletely mounted on said first connector.

14. A connector connecting device according to claim 8, wherein said first connector is one of a female connector and a male connector, said second connector is the other of said female connector and said male connector.

15. A connector connecting device according to claim 8 further comprising a holding mechanism which holds said lever by engagement with said first connector when said slide member is kept in a drawn-out condition relative to said second connector.

16. A connector connecting device according to claim 15, wherein said second connector includes a holding cancellation member for canceling said engagement between said lever and said first connector when said first connector is inserted into or drawn from said second connector.

* * * * *